US009100757B2

(12) United States Patent
Johnson et al.

(10) Patent No.: US 9,100,757 B2
(45) Date of Patent: Aug. 4, 2015

(54) HEADSET IMPEDANCE DETECTION

(75) Inventors: Timothy M. Johnson, San Jose, CA (US); Adriane S. Niehaus, San Jose, CA (US)

(73) Assignee: Apple Inc., Cupertino, CA (US)

( * ) Notice: Subject to any disclaimer, the term of this patent is extended or adjusted under 35 U.S.C. 154(b) by 350 days.

(21) Appl. No.: 13/540,454

(22) Filed: Jul. 2, 2012

(65) Prior Publication Data

US 2014/0003616 A1 Jan. 2, 2014

(51) Int. Cl.
*H04R 1/10* (2006.01)
*H04R 29/00* (2006.01)

(52) U.S. Cl.
CPC ..... *H04R 29/001* (2013.01); *H04R 1/10* (2013.01)

(58) Field of Classification Search
CPC .. H04R 5/04; H04R 2420/01; H04R 2420/03; H04R 2420/05; H04R 29/00
USPC ..... 381/74, 118, 120, 111–117; 330/199, 330/257, 297
See application file for complete search history.

(56) References Cited

U.S. PATENT DOCUMENTS 5,642,424 A * 6/1997 Masaki ..... 381/309
6,069,960 A * 5/2000 Mizukami et al. ..... 381/74
6,359,987 B1 3/2002 Tran et al.
6,812,715 B2 11/2004 Chiozzi et al.
7,099,481 B2 * 8/2006 Baker et al. ..... 381/58
7,130,184 B2 * 10/2006 Choi ..... 361/679.23
7,697,697 B2 4/2010 Su et al.
7,764,797 B2 7/2010 Yamamoto et al.
7,916,875 B2 * 3/2011 Kanji ..... 381/58
8,670,571 B2 * 3/2014 Clemow ..... 381/71.1
2004/0080440 A1 * 4/2004 Su et al. ..... 341/141
2004/0081099 A1 * 4/2004 Patterson et al. ..... 370/241
2005/0013447 A1 * 1/2005 Crump et al. ..... 381/71.6
2007/0057720 A1 * 3/2007 Hand et al. ..... 330/10
2007/0127742 A1 * 6/2007 Seven ..... 381/111
2008/0159567 A1 * 7/2008 Lesso et al. ..... 381/120
2008/0260183 A1 * 10/2008 Hertzberg et al. ..... 381/119
2011/0128019 A1 * 6/2011 Saito ..... 324/713
2013/0070930 A1 * 3/2013 Johnson ..... 381/57

* cited by examiner

*Primary Examiner* — Xu Mei
(74) *Attorney, Agent, or Firm* — Blakely, Sokoloff, Taylor & Zafman LLP

(57) ABSTRACT

Whether an audio output amplifier of an electronic device is connected through an accessory connector to a headphone or a self powered audio device is determined by sensing the signature of the input power signal in an input power line to a voltage regulator circuit that ultimately powers the amplifier. The signature is sensed flowing through a sense circuit that is in series in the input power line while the amplifier outputs a high power, inaudible signal to the connected device. The signature is output to a controller. The controller indirectly determines from the signature, whether the impedance of the connected device is that of (1) a headphone (speaker) for which a headphone amplifier is selected to provide more power for a lower impedance load, or (2) a self powered output device ("line in" input) for which a "line out" amplifier and isolation resistor are selected to drive a high capacitive load.

20 Claims, 13 Drawing Sheets

HEADPHONE MODE

LINE OUT MODE

LINE OUT MODE

HEADSET IMPEDANCE DETECTION

FIELD

An embodiment of the invention relates to electronic audio systems and automatically configuring audio output amplifiers and output impedance for improved audio performance, such as after determining the input impedance of an audio device connected to the amplifiers through an accessory connector. Other embodiments are also described.

BACKGROUND

Audio systems such as consumer electronic portable devices including smart phones and digital media players have a headphone or earphone jack through which the portable device can interface with an accessory device, such as a directly powered headset. An audio integrated circuit referred to as an audio codec is used within the portable device, to convert digital audio files and digital audio streams into analog form, which is then driven by an audio power amplifier whose output is coupled to a speaker signal pin or contact of the headphone jack. In addition, the audio codec also includes the capability of converting an audio signal from analog into digital form, where the input analog signal can be obtained from an integrated microphone within the headset that is plugged into the headphone jack. The audio codec is typically equipped with several such audio channels, allowing digital audio to be played back through either the earpiece receiver in the case of a smart phone, a speakerphone, or through the headphone jack to external earphones. It has also been suggested that the earphone jack be used to attach the audio system to a standalone device such as a self-powered speaker, a television, or a home theater audio amplifier/receiver.

SUMMARY

Embodiments of the invention sense whether an audio output amplifier of an audio system is connected through an accessory connector to a headphone device or to a self powered audio output device (e.g., "line-in" device), by sensing the signature of an input power signal that powers the amplifier. In some cases, the signature can be sensed by monitoring the amount of current flowing through a passive sense resistor with a known value, which is series-coupled between a power input of a voltage regulator circuit and a power supply node that supplies power or ground to the voltage regulator. In other cases, the signature can be sensed by monitoring an amount of voltage across a load or a parasitic resistance of a sense circuit. Monitoring may be performed while outputting a known test signal having sufficiently high power and an inaudible frequency, from the amplifier, through the accessory connector. An audio integrated circuit (e.g., "codec") may include a digital-to-analog converter (DAC), the amplifier (e.g., a headphone amplifier having variable gain for setting the volume) with an input coupled to an output of the DAC and an output coupled to the accessory connector, and a voltage regulator having a power input connected to the input power pin and an output that provides power to the amplifier.

The signature of the signal across the sense resistor or detected in the sense circuit can be used to determine the impedance characteristics of the load attached to accessory connector, and hence the type of load. The signature can be processed (e.g., digitally), to determine whether the impedance of the device that is connected to the accessory connector indicates the device is a headphone (e.g., low resistance of a headset speaker) or a self powered audio output device (e.g., higher resistance for the "line-in" input of a home or vehicle entertainment system receiver/amplifier). The signature can be detected by an analog-to-digital converter (ADC) of the codec, whose input is coupled across the sense resistor to read a current signal through the sense resistor.

This setup allows a programmed processor to program the DAC to cause the amplifier to output the known test signal, while simultaneously monitoring the output of the ADC to measuring the resulting current signature across the sense resistor or detected in the sense circuit. The test signal requires enough power drain from the voltage regulator or headphone amplifier, for the processor to determine whether an impedance difference between a line-in input self powered audio output device and a speaker input of a headphone device attached to the connector. The sense resistor or sense circuit need not be directly coupled to the output of the amplifier or any other part of the connector. The measured current across sense resistor or the voltage detected in the sense circuit depends upon how much power the voltage regulator has to output to the audio amplifier, which depends on how much impedance (resistance) is coupled to the audio amplifier output. Therefore, the output impedance of the amplifier can be indirectly measured.

Based on the impedance measured, the programmed processor can then select a line out mode (e.g., for self powered audio output device) or headphone audio output mode of operation mode by selecting a different audio amplifier and output impedance for proper operation of the electronic audio system. Based on detecting the impedance (e.g., higher resistance) for a self powered audio output device, a "line-in" input having a higher capacitive load and a "high" load resistance is expected (e.g., for a typical "line-in" device). Thus, in response to this detection, the programmed processor can select a special lower power "line out" amplifier, and a series isolation resistor in series in the amplifier's output to decouple the output from the typically high capacitive load that is presented by a line-in device.

Alternatively, based on detecting the impedance (e.g., lower resistance) for a headphone device, a headphone input (e.g., speaker to be powered by the headphone amplifier), having a lower capacitive load and a "low" load resistance is expected (e.g., for a typical headphone speaker). Thus, in response to this detection, the programmed processor can select the higher power headphone amplifier (without a series isolation resistor) to drive a lower headphone impedance load (e.g., the speaker). Thus, this setup may provide a proper audio experience for the user, replace large switches to switch in and out the series isolation resistors at the outputs, and replace the making connected audio device impedance measurements at the audio amplifier outputs.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments of the invention with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1:
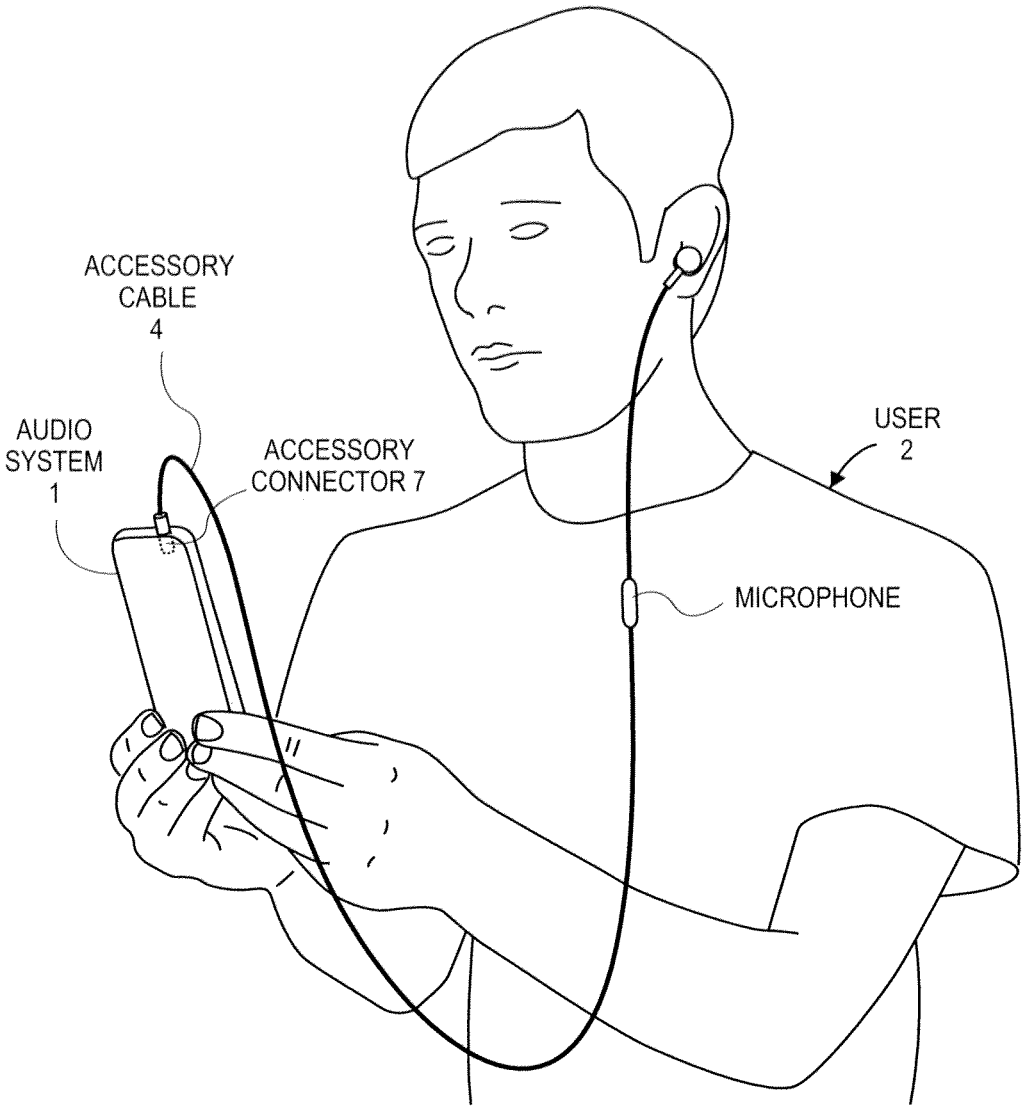
FIG. 1 shows an audio system in use while in the headphone mode.

FIG. 1 shows an audio system 1 in use while in a headphone mode of operation. In this example, the audio system 1 is a portable device that is also handheld, such as a smart phone, a digital media player, or a tablet computer. The audio system 1 has a housing in which an accessory connector 7, e.g. a headphone or earphone jack, is integrated. An accessory cable 4 is connected to the accessory connector 7 at one end, and is terminated at another end by an earphone and by a microphone. The accessory cable 4 can be part of a conventional, wired headset combination. The audio system 1 can be "playing" any digital audio content through the accessory cable 4, including, for instance, a locally stored media file such as a music file or a video file, a media file that is streaming over the Internet, and the downlink speech signal in a two-way real-time communications session, also referred to as a telephone call or a video call. The latter is enabled by the external microphone that is connected to the cable 4, which can be used to pickup the speech of the user 2 during the call. In some cases, cable 4 is part of a conventional non-self powered speaker system that requires its speakers be powered by system 1.

Figure 2:
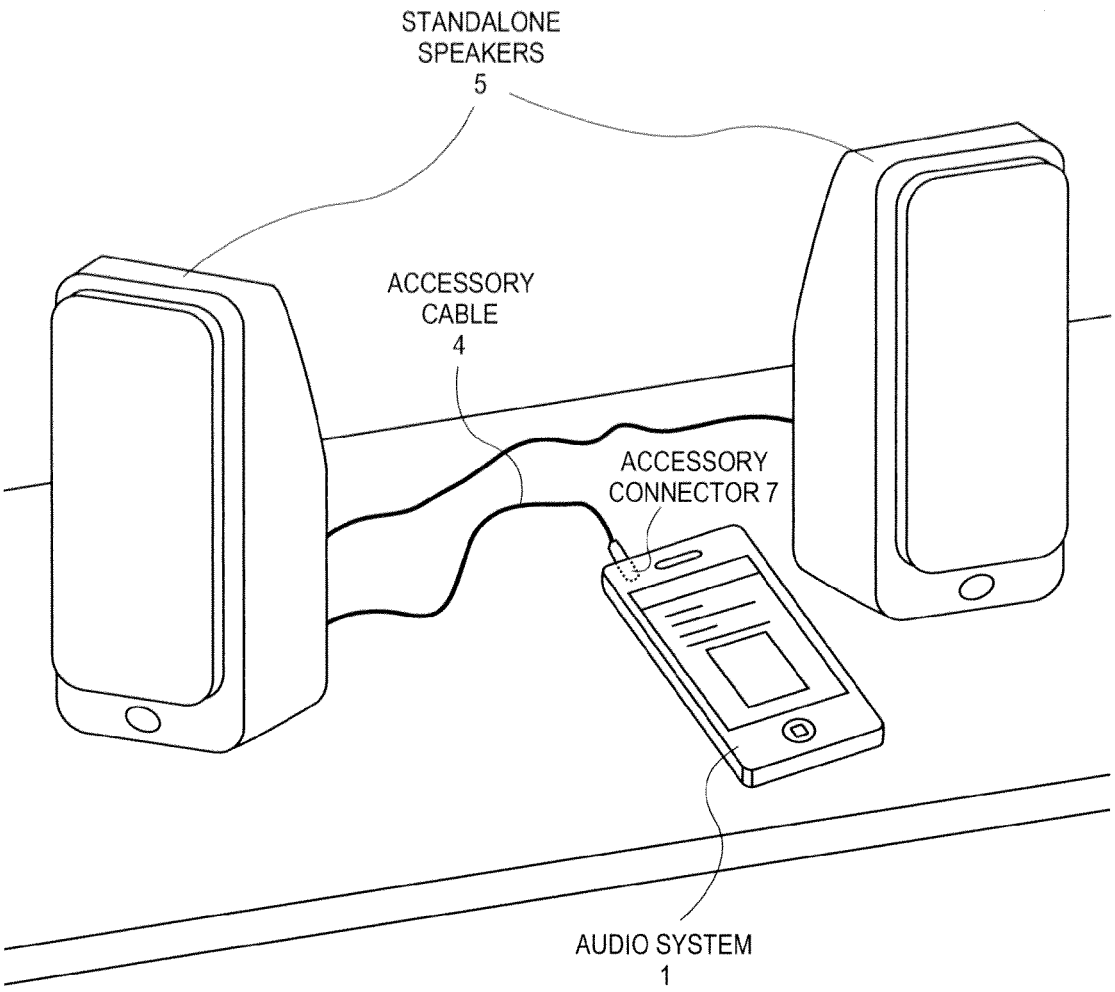
FIG. 2 shows the audio system in use while in the line out mode.
Figure 3:
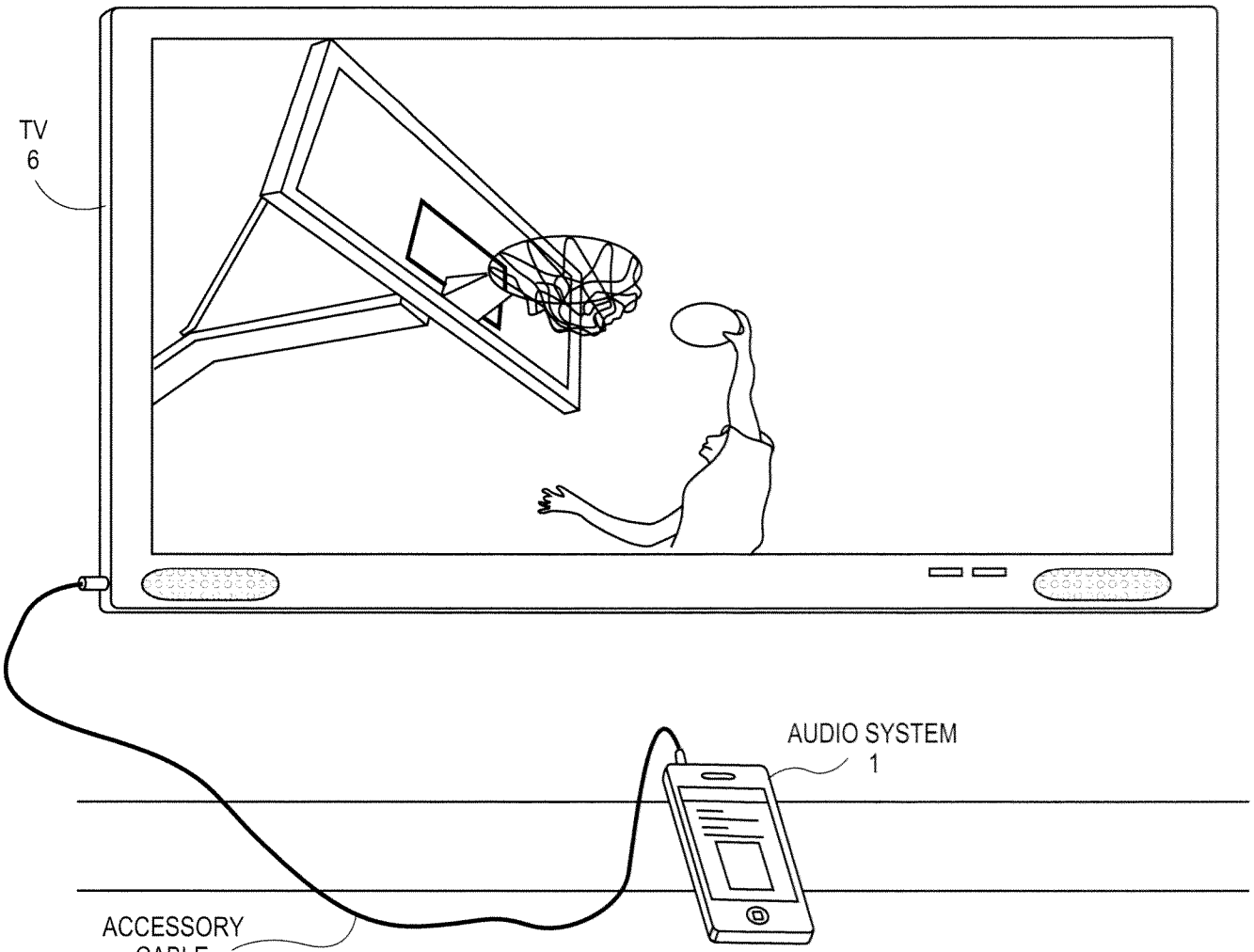
FIG. 3 shows the audio system in use while in line out mode.

FIG. 2 shows the audio system 1 in use while in the line out mode. Here, the accessory cable 4 terminates at standalone speakers 5 which may be separately powered, rather than relying upon obtaining power from the audio system 1 through the accessory cable 4 (see FIG. 1 where the earphone and microphone are both powered by the audio system 1 through the accessory cable 4). Another example of line out mode is shown in FIG. 3 where the load that is attached to the accessory connector 7 is the line-in port of a television 6. It is considered that speakers 5 and television 6 may include one or more audio preamplifiers that then drive the speakers. The input impedance of the audio preamplifiers may be higher than that of cable 4 of FIG. 1, which may be part of a conventional headphone or non-self powered speaker system that requires its speakers be powered by system 1, and typically has a lower impedance.

One difference between line out mode and headphone mode is the different output impedance presented on the audio contact (e.g., signal pin) of the connector 7, to the attached load. Typically, a directly powered earphone presents a substantially lower impedance than the audio amplifier input of a standalone speaker 5 or a television 6. The expected impedance seen by the audio system 1 looking into the accessory cable 4 may be on the order of less than 100 ohms when driving an earphone, while that impedance when driving the input port of a self-powered speaker 5 or television 6 may be on the order of between 1 kilo ohms and 20 kilo ohms. In addition, it has been found that in several instances of line out mode, the audio system 1 is faced with a substantially higher parasitic capacitance, that may be modeled as a shunt capacitance, as compared to the headphone mode. This larger shunt capacitance may cause an integrated power amplifier of an audio codec (which is driving the audio content into the accessory cable 4) to become unstable in line out mode. While it is possible to modify the power amplifier to enable it to drive higher capacitance loads, doing so presents a tradeoff against other design parameters that are relevant, including, in particular, an increase in power which for portable devices is difficult to accept. It can be appreciated that the concepts above regarding television 6 are also applicable for line out devices such as a self-powered speaker, an automobile (or other vehicle), a boat, a computer, and a home theater audio amplifier/receiver (e.g., home audio component).

Figure 4:
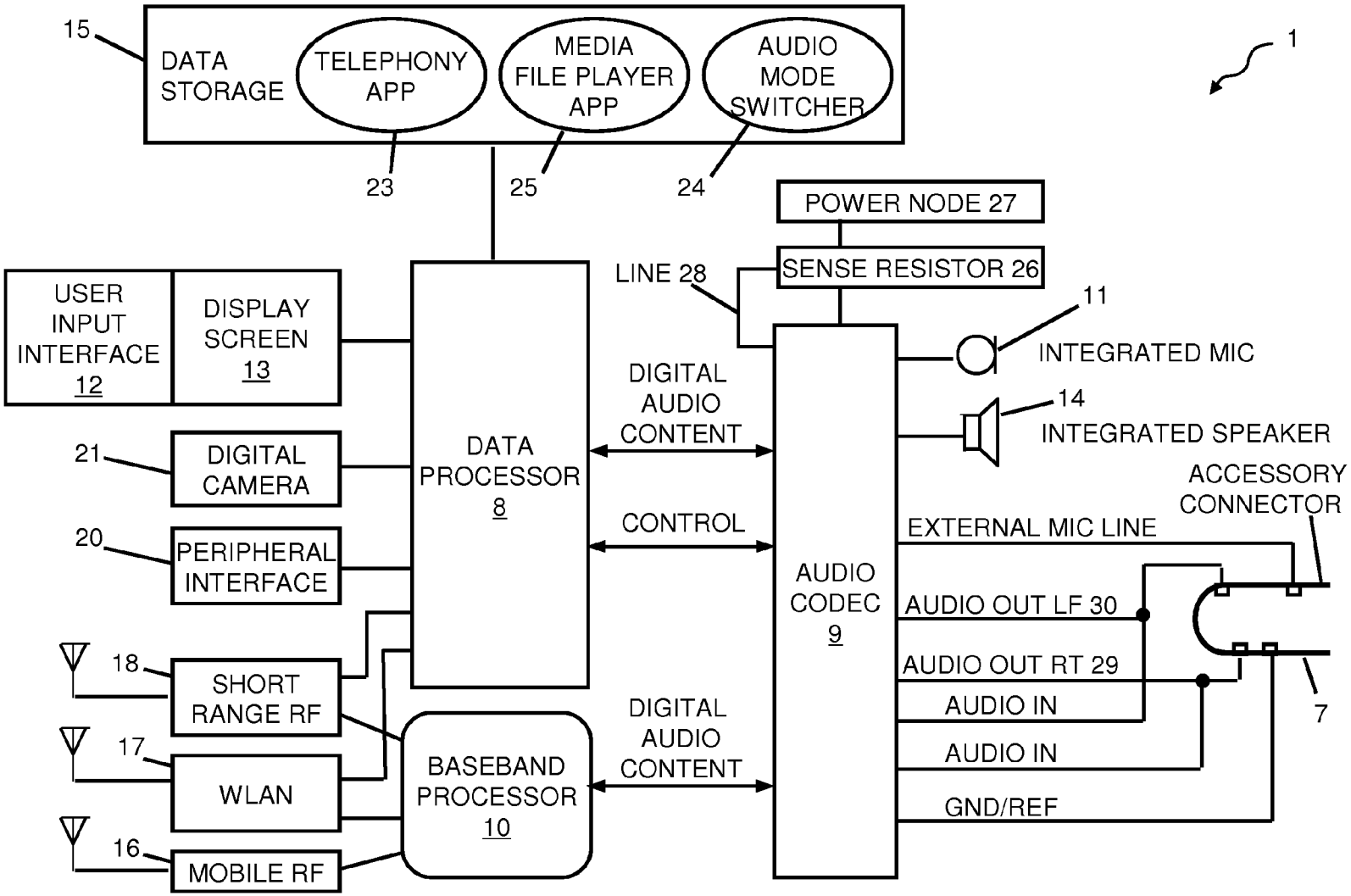
FIG. 4 is a combined block diagram and circuit schematic of relevant portions of a portable communications device, as an example of the audio system.

Before addressing the aspects of how to improve audio performance in both line out and headphone modes, a combined block diagram and circuit schematic of relevant portions of a portable communications device as an example of the audio system 1 is presented in FIG. 4. Being a portable device, the audio system 1 depicted in FIG. 4 is not only battery powered but also has several wireless communications interfaces, including a short range RF interface 18 (e.g., Bluetooth compatible), a wireless local area network interface 17 (also referred to as WiFi), and a mobile RF interface 16 (also referred to as a cellular terrestrial radio access network transceiver). A baseband processor 10 is responsible for digital encoding and decoding of communication content in the baseband or intermediate frequency band; such content may include audio content in the form of a downlink audio signal from a remote device (not shown) that may contain, for instance, the speech of a far-end user, and an uplink signal that may contain speech of a near-end user of the audio system 1. The audio system 1 depicted in FIG. 4 also includes other hardware such as a digital camera 21, and a local or peripheral interface 20 (e.g., a docking connector and associated circuitry, a universal serial bus interface). A display screen 13 is also provided, together with a user input interface 12. The latter may be in the form of a physical keyboard or keypad, although currently a touch panel together with the display screen 13 forming a touch screen is a popular alternative.

The various functions of the audio system 1 may be managed by a data processor 8, which in the case of a portable multi-function consumer electronic device may be an applications processor, a central processing unit, or a system on a chip (SoC). The term "data processor" is used generically here to refer to any suitable combination of data processing circuitry. The data processor 8 is programmed by instructions stored in data storage 15, depicted here as applications or modules including a telephony application 23 (to enable voice or video calls), and a media file player application 25 (to enable playback or streaming of digital audio and video files). The data storage 15 may be composed of non-volatile memory such as flash memory or a hard disk drive, in addition to random access memory.

Audio output is achieved through the accessory connector 7, which may be integrated within the housing (not shown) of the audio system 1 together with the hardware components depicted in FIG. 4. The accessory connector 7 may be a headphone or earphone jack, such as a 4-pin TRRS connector, having 4 contacts (e.g., pins) to contact 4 corresponding contact regions of an accessory plug. The four contacts may include an external microphone line contact, left and right speaker contacts, and a ground or reference contact. Other contact assignments and jack styles are possible. For example, the connector may have contacts corresponding to a four region plug including a microphone region (with a ground region located between the microphone region and an audio signal region), a three region plug including a microphone region (with a ground region located between the microphone region and only one audio signal region), or a three region plug with no microphone region (e.g., stereo plug) having two audio regions. At least one contact of the connector may be an audio contact (e.g., for left speaker, right speaker, mono speaker, or combined left and right speaker signal) to contact at least one corresponding audio contact region of an accessory plug. In general, the connector 7 is designed to interface the audio system 1 with an external device, namely an accessory device such as a directly powered headset, or a standalone device such as a self-powered speaker or an audio amplifier.

The contacts (e.g. pins) of the accessory connector 7 are coupled to audio codec 9. The codec 9 may be an integrated circuit (e.g., "audio IC") having a digital to analog converter (DAC), an analog to digital converter (ADC), and an audio power amplifier. The audio codec 9 may be a single integrated circuit die that is separately packaged by itself or in combination with other circuitry, as an audio IC package. It has, in this case, at least two analog audio output contacts, which are connected to audio outputs right 29 (for right channel) and left 30 (for left channel) that are driven by their respective power amplifiers to the corresponding signal contacts of the accessory connector 7. As noted herein, single audio channel embodiments are also contemplated. The audio content is driven by the audio codec 9 relative to the ground/reference contact of the connector 7. The audio content that is output by the codec 9 may be produced or routed by the data processor 8 (e.g., while playing a digital audio file under control of the media file player app 25), or the baseband processor 10 which may be decoding and delivering a downlink speech signal during a call. Codec 9 also has several input contacts, including an external microphone line input and, in this case, at least two separate audio input contacts (e.g., also coupled to audio contacts of connector 7). The external microphone line allows the audio codec 9 to receive input audio content from an external device, e.g. speech of a near-end user, through the microphone contact of the accessory connector 7.

FIG. 4 shows sense resistor 26 coupled between power node 27 and a power input pin or contact of codec 9. It also shows line 28 is coupling resistor 26 to an input pin or contact of codec 9. Line 28 may be able to provide a signal used to determine the voltage across and/or current flowing through resistor 26. For example, the ADC in the codec (e.g., having an input) may be able to use that signal to detect a fixed frequency voltage across a current sense resistor (e.g., resistor 26).

Data storage 15 may also have stored therein an audio mode switcher 24 which programs the processor 8 to select an audio output mode of operation, being one of line out mode and headphone mode. In so doing, the audio mode switcher 24 controls or configures codec 9 (e.g., using processor 8; see "CONTROL" from processor 8 to codec 9) in order to determining the impedance of an audio device connected to the amplifiers by sensing the signature of an input power signal to the amplifier. Audio mode switcher 24 may also control or configure codec 9 in order to change or switch between different audio output amplification and output impedance (e.g., for line out or headphone) that is presented at one or more contacts (e.g., signal pins) of the accessory connector 7, such as through audio out lines 29 and 30. These and other aspects of the various embodiments of the invention will be described next.

According to some embodiments, switcher 24 includes a computer program stored in a storage medium. Such a computer program (e.g., program instructions) may be stored in a machine (e.g. computer) readable non-volatile storage medium or memory, such as, a type of disk including floppy disks, optical disks, CD-ROMs, and magnetic-optical disks, read-only memories (ROMs), erasable programmable ROMs (EPROMs), electrically erasable programmable ROMs (EEPROMs), magnetic or optical cards, magnetic disk storage media, optical storage media, flash memory devices, or any type of media suitable for storing electronic instructions. Processor 8 may be coupled to the storage medium 24 to execute the stored instructions. The processor may also be coupled to a volatile memory (e.g., RAM) into which the instructions are loaded from the storage memory (e.g., non-volatile memory) during execution by the processor. The processor and memory(s) may be coupled to control codec 9 as described herein. In some cases, the processor may include controller 45 (e.g., see FIGS. 5-6) as described herein. Processor 8 may include controller 45, also controlled by the computer program (e.g., program instructions), such as those stored in the machine readable non-volatile storage medium of switcher 24.

Figure 5A:
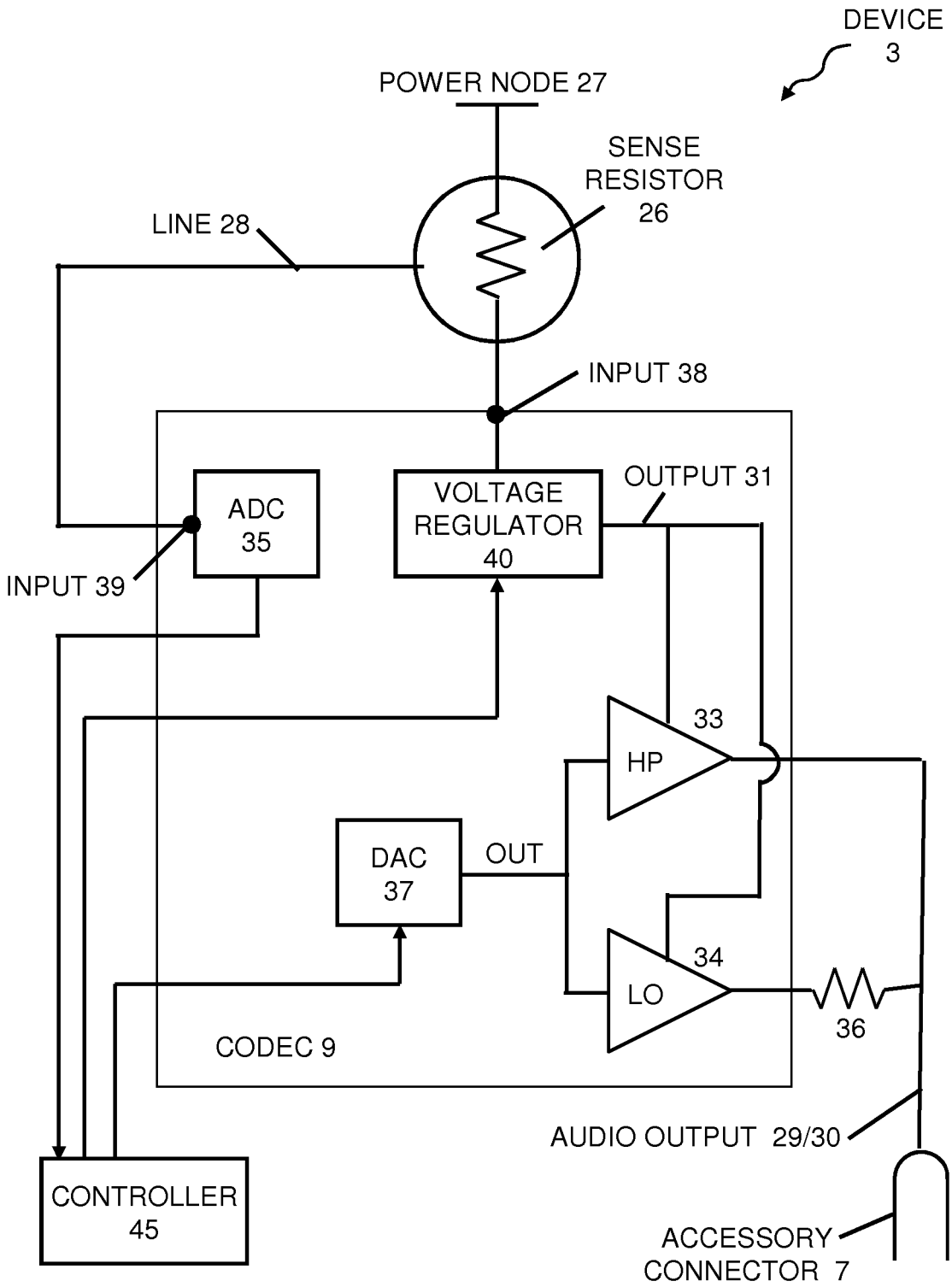
FIGS. 5A-C are circuit schematics of example configurations of a sense resistor coupled in series between a power node pin to power an audio codec and a power input pin of the audio codec.
Figure 5B:
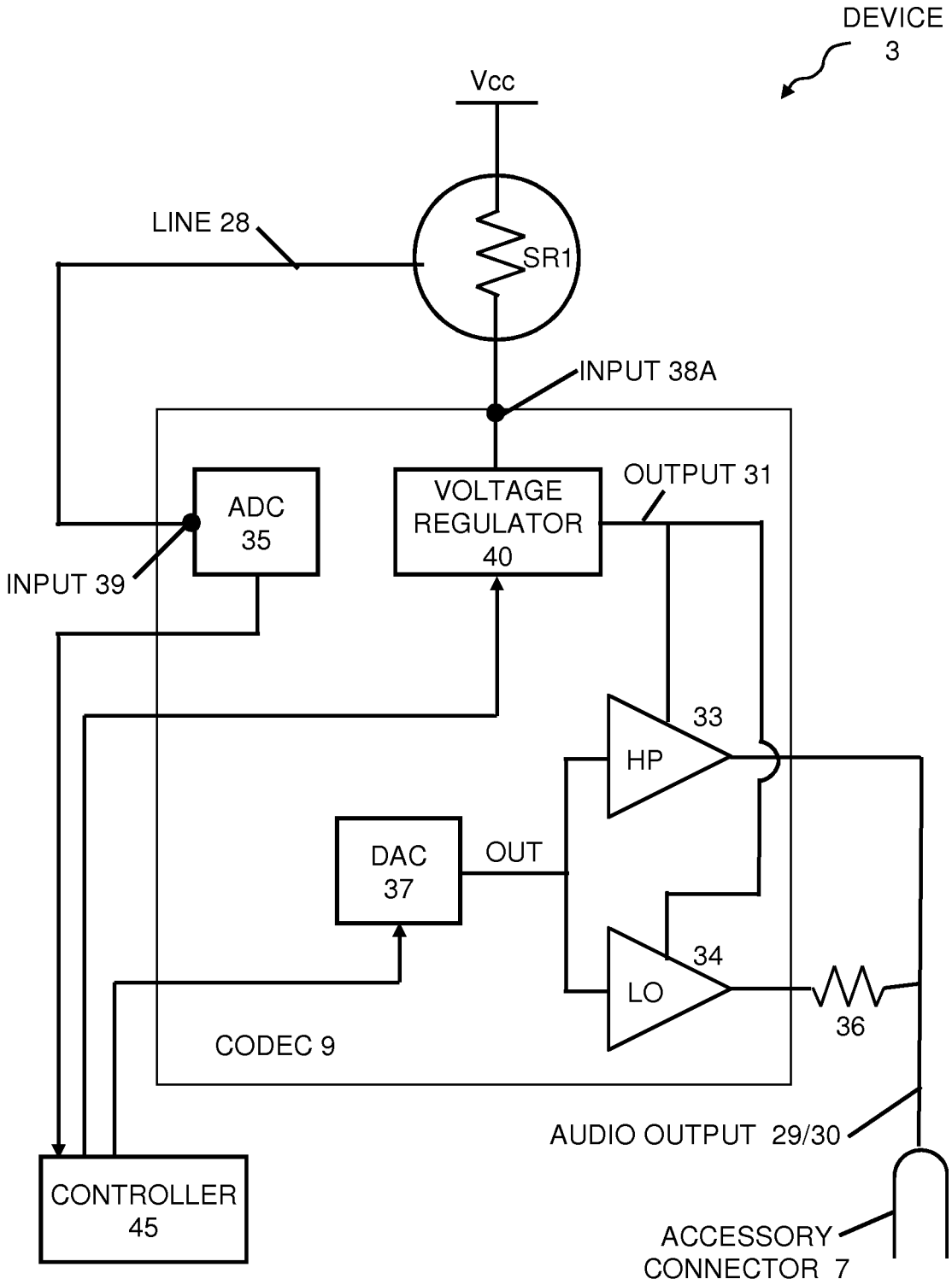
Figure 5C:
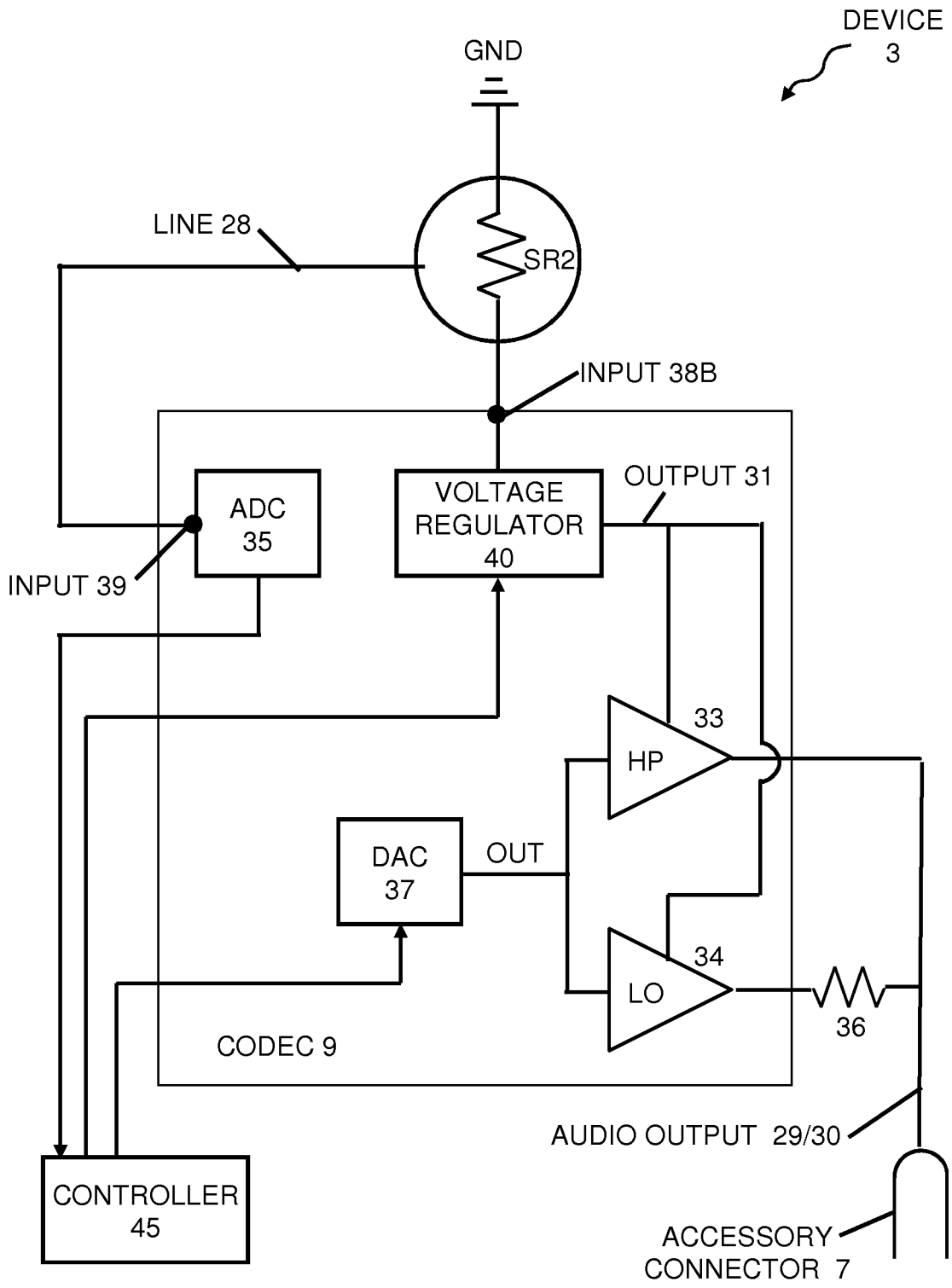

Turning now to FIGS. 5A-C, which show circuit schematics of example configurations of a sense resistor coupled in series between a power node pin to power audio codec 9 and a power input pin of the audio codec. In this example, only one audio output channel is shown (the amplifier outputs are represented as audio output 29/30), having its own DAC, however, the principles described here are applicable to stereo audio output channels (e.g., see FIG. 6) or more than two audio output channels.

FIG. 5A shows electronic audio device 3 (e.g., a part of audio system 1) including headphone amplifier 33 to provide a headphone amplified audio output signal, and line out amplifier 34 to provide a line-out amplified audio signal to accessory connector 7 through audio output 29/30. The higher power headphone amplified audio output signal has proper output power, characteristics and impedance for a headset (e.g., a headphone or headset having at least one, and optionally a microphone) having a plug inserted into and having contacts in contact with corresponding contacts of connector 7. The lower power line out amplified audio output signal has proper output power, characteristics and impedance for a line out device (e.g., a self powered audio output device having at least one, and optionally a microphone input) having a plug inserted into and having contacts in contact with corresponding contacts of connector 7. Digital to analog converter 37 has its output coupled to inputs of the headphone and line out amplifiers to provide an audio input signal to the headphone and the line out amplifier. Voltage regulator circuit 40 is coupled to power output 31 to provide power (e.g., bias) to the headphone amplifier, and to the line out amplifier.

Digital audio content that is to be sent out of the codec 9 is converted by DAC 37 into analog format, and then driven by audio power amplifier 33 or 34 (e.g., class AB amplifiers); the power amplifiers have variable gain to yield variable sound volume. The output pins of the audio codec 9 are coupled at least one audio contact of accessory connector 7. In order to switch between different audio output amplification and output impedance (e.g., for line out or headphone) at the signal pin of the accessory connector 7, the codec 9 switches between selecting headphone audio amplifier 33 or line out audio amplifier 34 in accordance with a control signal, under control of controller 45. Thus, codec 9 may be used to "turn" or switch on and off different line out and headphone power amplifiers that contact or are electrically connected through audio output line 29/30 to connector 7. The electrical connection between the line out power amplifier passes through output isolation resistor 36 before passing to the corresponding signal pins of the accessory connector 7 to increase the output impedance. Series-coupled isolation resistor 36, may be a passive resistance element of a know value, which depends on the codec design (e.g., amplifier 34) and an expected input impedance of a line-in device. The electrical connection between the headphone power amplifier may not pass through an output isolation resistor (e.g., a resistor 36), to thereby decrease the output impedance (e.g., as compared the line out impedance). It is considered that in some embodiments, an isolation resistor (e.g., similar in function to resistor 36) could be inline the amplifier output (e.g., line 29 and 30); and a switch, in parallel with this resistor, can be switched in and out to short out the resistor when driving headphone loads. It is also considered that in some embodiments, the isolation resistor (e.g., resistor 36) could be internal to the codec with routing to pins of the codec that connect to lines 29/30. In this case, resistor 36 would be located on or in the codec, and not disposed or located external to codec 9, such as by being a components on or in an IC or die containing circuitry of codec 9. Some embodiments may also include a mode switching mechanism whereby the transitions between selecting audio power amplifier 33 or 34 are gradual and smoothed as to avoid audio artifacts. For example, in the case where isolation resistor 36 is inline with headphone amplifier output and a parallel switch is used to short across them, it is possible to make the switch transition from high impedance (e.g., line our mode, with resistor 36) to very low impedance (headphone mode) gradually, such as by selecting audio power amplifier 33 or 34, and then switching resistor 36 in our out. Changing the output audio amplifiers and impedance in this manner allows the audio system 1 to more accurately and efficiently drive the load that is attached to the accessory connector 7.

Sense resistor 26 is coupled between input power pin 38 of audio codec 9 and power node contact or pin 27 to supply power (e.g., bias) or ground signals to the audio codec. Line 28 is shown as an external line or connection, coupling resistor 26 to input 39 of ADC 35. Line 28 may represent two or more electronic connections, wires or PCB traces attached or coupled to opposite ends of resistor 26 so that ADC 35 can determine the voltage across and/or current flowing through resistor 26.

Analog to digital converter 35 may have input 39 coupled to detect a voltage or current (e.g., a "signature" of an AC signal over time) across sense resistor 26 that is in series with power node 27 (e.g., Vcc main or GND) of voltage regulator circuit 40. ADC 35 and input 39 may also be used to detect a microphone input from a microphone contact of the accessory connector, such as from the external microphone line input (e.g., see description of FIG. 4). For example, input 39 may also be coupled to the external microphone line input of connector 7.

Controller 45 (e.g., part of programmed processor 8, and in some cases controlled by switcher 24) is coupled to the digital to analog converter, the voltage regulator circuit and the analog to digital converter. The controller may be configured to process an output of the analog to digital converter 35 to detect a current and/or voltage across the sense resistor 26, and based on that current and/or voltage, to detect the impedance (e.g., resistance) of a device coupled to an output of the headphone or line out amplifier. The device coupled may have a plug inserted into connector 7 and be coupled through output 29 and 30 to the amplifier. In some cases this detection is of an audio device with contacts coupled only to the headphone amplifier.

FIG. 5B shows a version of FIG. 5A where sense resistor 26 is identified as SR1 coupled between input Vcc bias power pin 38A of audio codec 9 (e.g., of voltage regulator circuit 40) and an output Vcc power node to supply power signals to the audio codec. FIG. 5C shows a different version of FIG. 5A where sense resistor 26 is identified as SR2 coupled between input ground (GND) power pin 38B of audio codec 9 (e.g., of voltage regulator circuit 40) and an output GND power node to supply ground signals to the audio codec. It can be appreciated that the circuitry of digital converter 35 and input 39; and the processing of controller 45 can be adapted to work with any of the embodiments described herein.

According to embodiments, the sense resistor, power node, and line 28 may be disposed or located external to codec 9, such as by being components electrically connected to pins or contacts (e.g., which may be represented as part of inputs 38 and 39) of an IC or die containing circuitry of codec 9. Also, according to embodiments, controller 45 and resistor 36 are disposed or located external to codec 9, such as by being components electrically connected to pins or contacts (e.g., at the edge of codec 9 where they exit codec 9) of an IC or die containing circuitry of codec 9. Any one, any combination, or all of these external components may be independent or separate components located on a separate IC (e.g., part of an audio IC package), a separate printed circuit board (PCB), or a PCB upon which codec 9 is mounted, attached and/or electronically coupled. In some cases, sense resistor 26, the power node 27, and line 28 may be passive circuitry, a power node (e.g., pin), and traces located external to (but electrically connected to) the printed circuit board (PCB), chip, die or wafer upon which codec 9 is located.

The arrangement in FIGS. 5A-C may be used for the purpose of providing the correct audio signal to a headphone device or a line out device. For example, embodiments of the invention senses whether output (analog) audio amplifier 33 of electronic audio device 3 are connected through an accessory connector 7 to a headphone or to a self powered audio output device (e.g., "line-in" device), by sensing the signature of the input power signal (e.g., see FIG. 8, signal 830) of voltage regulator circuit 40 that powers (e.g., output 31) the amplifier 33. The signature may be sensed by detecting the amount of current flowing through sense resistor 26 that is in series with the input power line (to input 38) while outputting a sufficiently high power, inaudible frequency signal from amplifier 33 through the connector 7. Input 39 (e.g., an input of a differential amplifier) may be coupled across the sense resistor 26, and the output of the amplifier may be coupled to the input of an analog to digital converter 35 so that the signature can be processed in the digital domain, to determine whether the impedance (e.g., resistance) of the device that is connected to the accessory connector 7 indicates the device is a headphone (low resistance) or a self powered audio output device (e.g., higher resistance for the "line-in" input of a home or vehicle entertainment system receiver/amplifier). To clarify, the sense resistor 26 is not directly coupled to the output of the amplifier 33 or any other part of the connector 7. Thus, converter 35 is not (e.g., can operate while excluding or without) reading an input from any of audio outputs or microphone line inputs of the connector, but is only looking at the change in the current across the sense resistor 26 which is in series with the power supply "in" port (e.g., see FIG. 5B having SR1 in series between Vcc and input 38A) or power "return" (ground) port (e.g., see FIG. 5C having SR2 in series between GND and input 38B) of voltage regulator 40 (or of an LDO of circuit 40). In other words, the measured voltage/current across resistor 26 depends upon how much power/current the power circuit/voltage regulator 40 has to output to the audio amplifier 33, which depends on how much impedance (resistance) is coupled to the audio amplifier 33 output. Therefore, these embodiments indirectly measure the output impedance of the amplifiers 33.

It is also considered that in some embodiments, the current sense resistor (e.g., resistor 26) could be internal to the codec with routing to the ADC also internal to the codec. In this case, resistor 26 and line 28 would be located on or in the codec, and not disposed or located external to codec 9, such as by being components formed on or in an IC or die containing circuitry of codec 9.

Figure 5D:
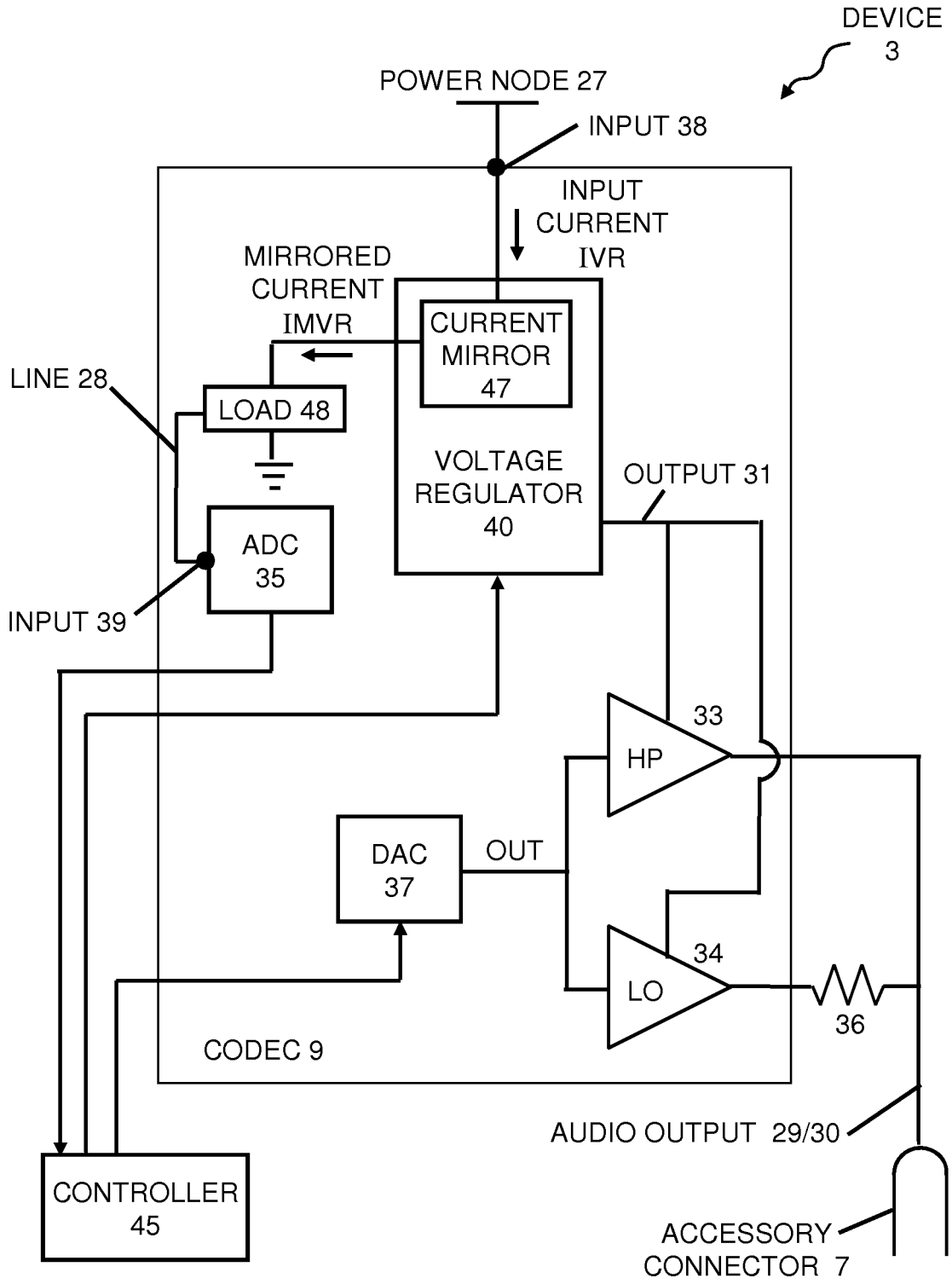
FIG. 5D shows an embodiment that senses the current flowing into the voltage regulator, to drive the headphone amplifier, by using a current mirror formed within the voltage regulator and used to drive a pre-determined load.
Figure 5E:
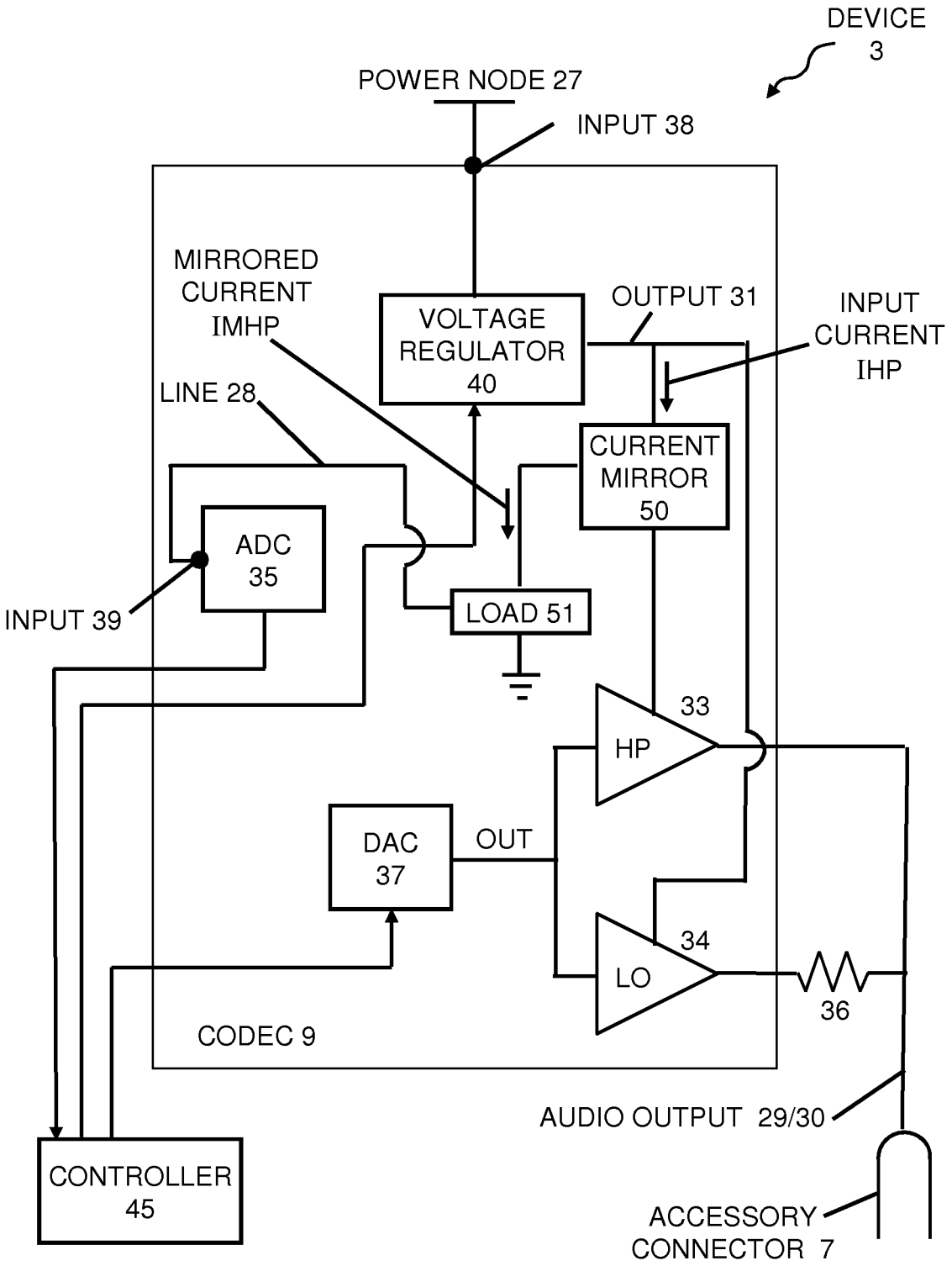
FIG. 5E shows an embodiment that senses the current flowing into the headphone amplifier, to drive the headphone amplifier output, by using a current mirror formed within the codec and used to drive a pre-determined load.
Figure 5F:
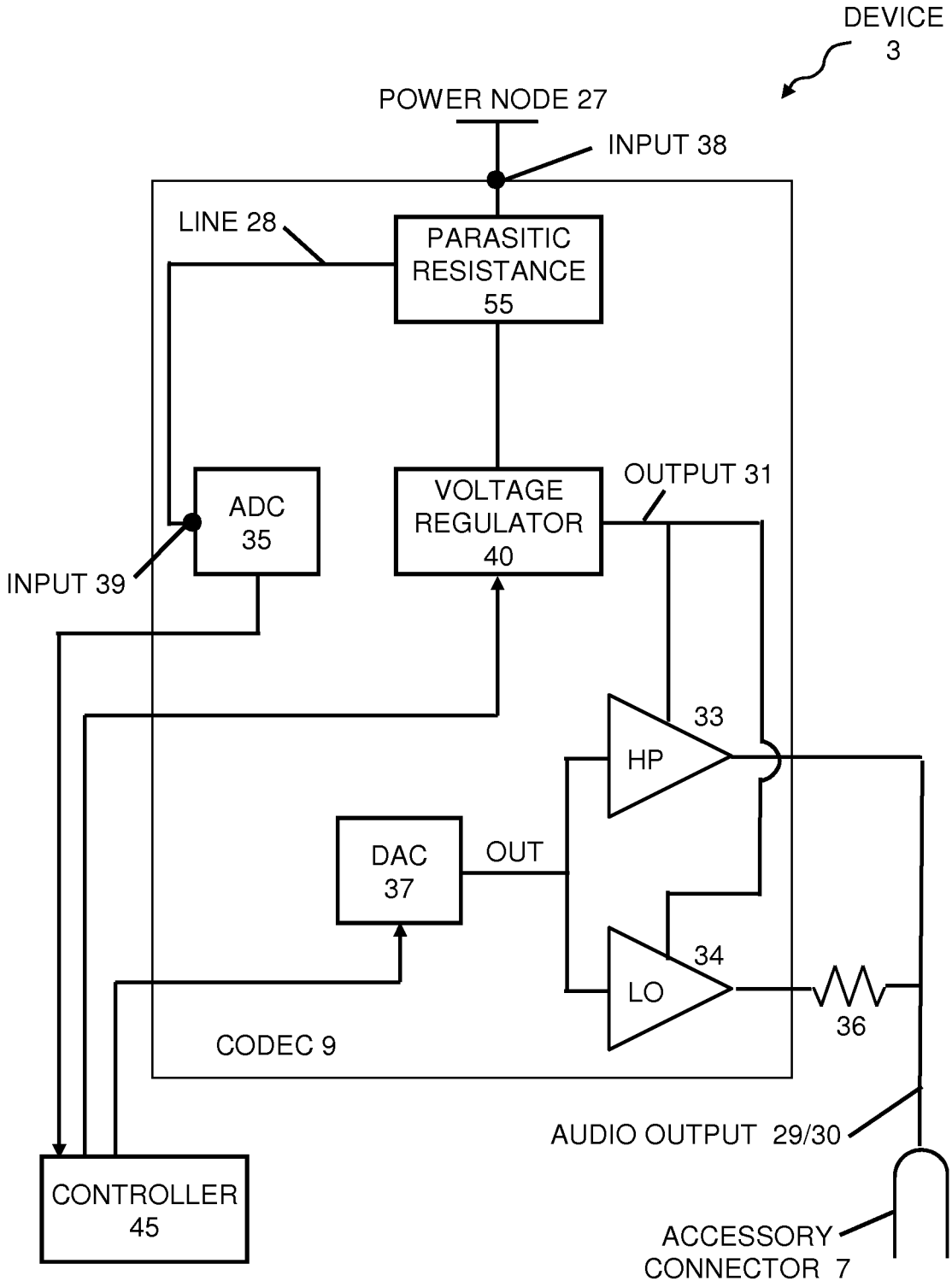
FIG. 5F shows an embodiment that senses the current flowing into the voltage regulator, to drive the headphone amplifier, by detecting the current flowing through a parasitic "sense" resistance between an input of the codec and an input of voltage regulator.

Additional embodiments of FIGS. 5D-F are now described for the purpose of providing the correct audio signal to a headphone device or a line out device. These embodiments may function similar to the descriptions of FIGS. 5A-C with the exceptions noted below.

FIG. 5D shows an embodiment that senses the current flowing into the voltage regulator, to drive the headphone amplifier, by using a current mirror formed within the voltage regulator (e.g., within codec 9) and used to drive a pre-determined load. For example, FIG. 5D shows input current IVR of regulator 40 being mirrored by current mirror 47 as mirrored current IMVR. Current IMVR creates a measured voltage across load 48 which may be coupled to ground. There may be a known relationship between (a) the measured voltage across the load, and (b) the input current IVR. The measured voltage may be detected (e.g., monitored during output of the test signal, as noted herein) by ADC 35 at input 39 through line 28. It can be appreciated that the measured voltage may be detected across the load using lines similar to lines 28A and at input similar to input 39 (e.g., a difference amplifier) of FIG. 6.

FIG. 5E shows an embodiment that senses the current flowing into the headphone amplifier, to drive the headphone amplifier output, by using a current mirror formed within the codec and used to drive a pre-determined load. For example, FIG. 5E shows input current IHP of the headphone amplifier 33 being mirrored by current mirror 50 as mirrored current IMHP. Current IMHP creates a measured voltage across load 51 which may be coupled to ground. There may be a known relationship between (a) the measured voltage across the load, and (b) the input current IVR. The measured voltage may be detected (e.g., monitored during output of the test signal, as noted herein) by ADC 35 at input 39 through line 28. It can be appreciated that the measured voltage may be detected across the load using lines similar to lines 28A and at input similar to input 39 (e.g., a difference amplifier) of FIG. 6.

FIG. 5F shows an embodiment that senses the current flowing into the voltage regulator, to drive the headphone amplifier, by detecting the current flowing through a parasitic "sense" resistance between input 38 and the input of regulator 40 (e.g., a parasitic resistance within codec 9). For example, FIG. 5F shows parasitic "sense" resistance 55 between input 38 and the input of regulator 40. A measured voltage across resistance 55 may be detected (e.g., monitored during output of the test signal, as noted herein) by ADC 35 at input 39 through line 28. It can be appreciated that the measured voltage may be detected across the load using lines similar to lines 28A and at input similar to input 39 of FIG. 6. For example the typical board and flex parasitic impedances and other isolation/filter component resistors (e.g., represented by resistance 55) are used for sensing the amount of load present to amplifier 33. The combined impedances may include resistor in series to regulator 40, inductor in series to regulator 40, and capacitor in parallel to ground type impedances. The combined impedances can be from a few tenths of an ohm to several ohms. In this case, this resistance is enough resistance to differentially sense across and estimate the amount of load current attached to connector 7. This parasitic "sense" resistance may be used to sense the current flowing into regulator 40, without adding a separate known, predetermined passive sense resistor 26 to device 3. In some cases, the impedance of resistance 55 may be detected or determined by laboratory tests of the impedance between input 38 and the input of regulator 40 of one or more (e.g., by averaging devices.

In some embodiments, line 28, resistor 26 (and optionally input 39 and ADC 35) may be described as a "sense circuit" to determine whether the impedance of a device coupled to the output of the headphone amplifier is the impedance of a headphone device or the impedance of a line out device" (e.g., see FIG. 5A-C). Next, in some cases line 28, mirror 47, and load 48 (and optionally input 39 and ADC 35) may be described as a "sense circuit" (e.g., see FIG. 5D). Next, in some cases line 28, mirror 50, and load 51 (and optionally input 39 and ADC 35) may be described as a "sense circuit" (e.g., see FIG. 5E). Also, in some cases line 28, resistance 55 (and optionally input 39 and ADC 35) may be described as a "sense circuit" (e.g., see FIG. 5F).

According to embodiments described for FIGS. 5D-F, with such circuitry it will be possible to "sense" the load voltage and determine if it's dramatically different than the source. For example, the presence of tones at the load (e.g., detected at ADC 35 through the sense circuit) which are not present in the source (e.g., test signal) or a noticeable increase in broadband noise may be indicative that the headphone amplifier is "unstable" and that going to High-impedance (e.g., line out) mode may be desired for optimal performance. Some embodiments include using the sense circuit to control a configurable headphone-out amplifier which has two distinct settings, essentially changing the operational point of the amplifier and tailoring it for a specific load (e.g., headphone or line out).

An advantage of the arrangements described herein is that depending on whether a headphone or a "line-in" device is indicated, a different audio amplifier can be selected for proper operation of the electronic audio system or device. The indication may be determined at, and the selection made by controller 45, such as controlled by audio mode switcher 24.

Based on detecting the impedance (e.g., higher resistance) for a self powered audio output device, a "line-in" input having a higher capacitive load and a "high" load resistance is expected (e.g., for a typical "line-in" device). In this case, a special lower power "line out" amplifier (e.g., "line out" amplifier 34) may be selected (rather than a "headphone" amplifier 33) that can more accurately and efficiently drive (e.g., with audio signals) a higher resistance and higher capacitive load than the headphone amplifier. The lower power line out amplifier (rather than a "headphone" amplifier) is able to drive a higher resistance "line-in" input, which requires less output power from the "line out" amplifier (e.g., 34) (e.g., saving battery life) than a "headphone" input which requires more power from the amplifier (e.g., 33) to drive a lower headphone resistance load (e.g., headset speaker).

In addition, based on detecting the higher resistance for the "line-in" input, a higher capacitive load is expected (e.g., for a typical "line-in" device). In this case, the line out amplifier has series isolation resistors (36) in its output that can be used to decouple the output from the typically high capacitive load that is presented by a line-in device. The isolation resistor increases the output impedance and therefore helps isolate the higher capacitance load; this improves robustness of the power amplifier when it is driving the higher capacitance load.

Alternatively, based on detecting the impedance (e.g., lower resistance) for a headphone device, a headphone input (e.g., speaker to be powered by the headphone amplifier), having a lower capacitive load and a "low" load resistance is expected (e.g., for a typical headphone speaker). Thus, in response to this detection, the programmed processor can select (or maintain) the higher power headphone amplifier (without a series isolation resistor) to drive a lower headphone impedance load (e.g., the speaker).

This indication and selection (e.g., by controller 45) also provides a proper audio experience for the user of the headphone or self powered speaker device (e.g., such as using media file player application 25 to enable playback or streaming of digital audio and video files). It also replaces the need for large switches used to switch in and out the series isolation resistors at the outputs of the audio output amplifiers. Finally, it replaces the use of making measurements at the audio amplifier outputs, which effects or provides a power drain at the output of those amplifiers.

Figure 6:
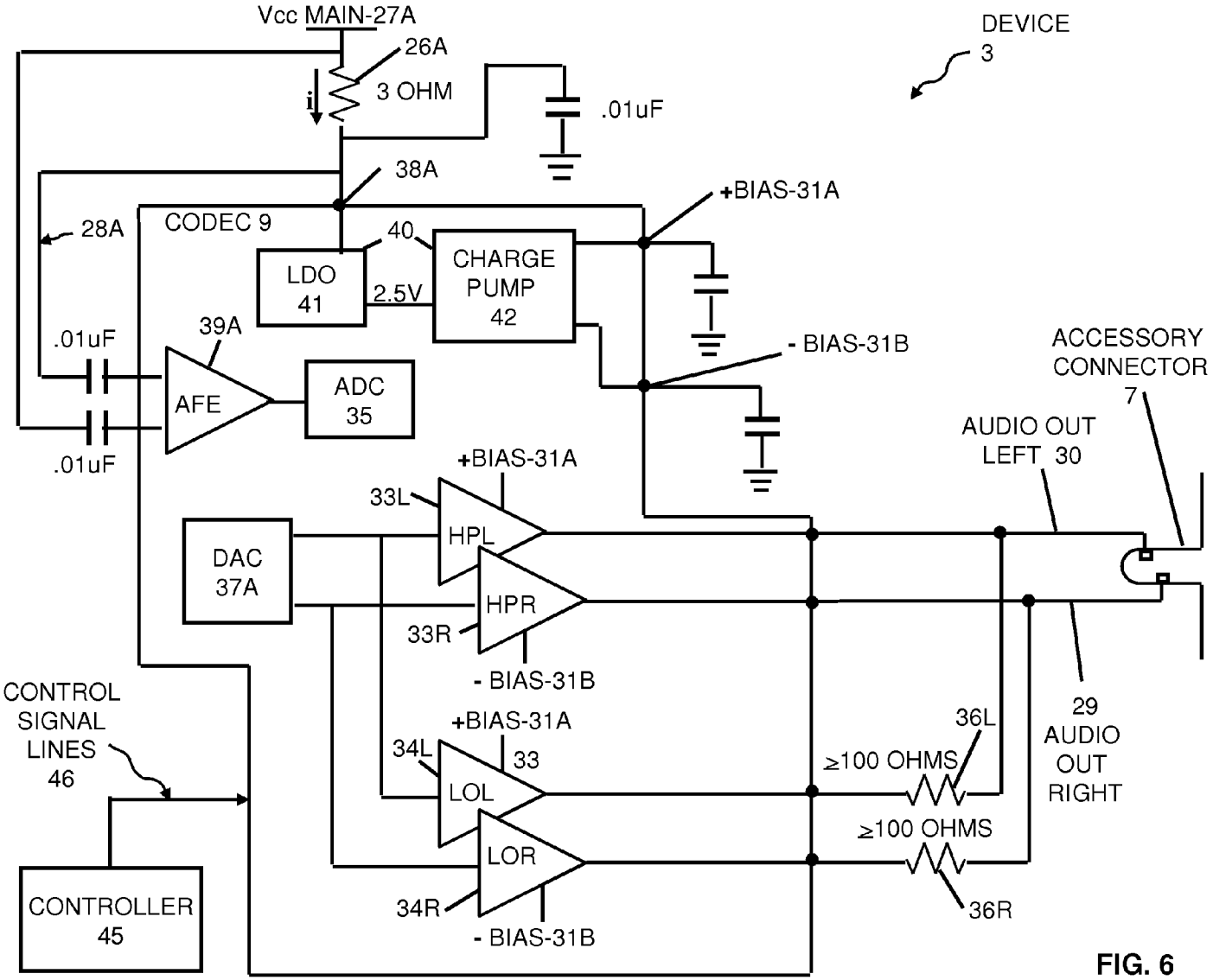
FIG. 6 is a circuit schematic of an example sense resistor coupled in series between a Vcc power pin and a power input pin of a voltage regulator of the codec.

FIG. 6 is a circuit schematic of an example of sense resistor 26A coupled between a Vcc main power pin 27A and a power input pin 38A of voltage regulator 40 of codec 9. This configuration is a more detailed "stereo" example of FIG. 5B where resistor SR1 is resistor 26A and Vcc is Vcc main 27A, but it can be appreciated that the descriptions of FIG. 6 can be easily adjusted for having resistor SR2 coupled between GND and input 38B of FIG. 5B. Similarly numbered components of FIG. 6 correspond to their descriptions in FIGS. 5A-C.

FIG. 6 shows electronic audio device 3 including headphone amplifier left 33L and right 33R channel amplifiers to provide a headphone amplified audio output signals, and line out amplifier left 34L and right 34R channel amplifiers to provide a line-out amplified audio signals to left and right audio contacts of accessory connector 7 through audio out right line 29 for a right channel, and audio out left line 30 for a left channel audio signal. The left and right channel amplifiers are each coupled to a left and right output of DAC 37A.

The left and right channel outputs of DAC 37A may be coupled to inputs of the left and right headphone and line out amplifiers to provide needed mono, or stereo (e.g., left and right) audio input signal to the headphone and the line out amplifiers, which in turn provide audio signals to left and right audio contacts of accessory connector 7. This setup may be similar to the description for FIGS. 4-5 above, except that two channels of audio are shown in FIG. 6. In some cases, other than providing two channels of audio, DAC 37A, amplifiers 33L and 33R, and amplifiers 34L and 34R are similar to the descriptions for DAC 37, amplifier 33, and amplifier 34, respectively.

The left and right output pins of audio codec 9 (e.g., from amplifiers 33L/R and 34L/R) are coupled to a left and right audio contacts (e.g., signal pins) of accessory connector 7. The line out left and right outputs of 34L/R are coupled through series-coupled isolation resistors 36L/R, which may be passive resistance elements similar to resistor 36. Although FIG. 6 shows resistors 36L/R having a valued greater than or equal to 100 Ohms, it can be appreciated that different impedance values (or none at all for these locations) could be used, such as depending on the frequencies, signal levels, and signal characteristics of the signals expected and desired between amplifiers 34L/R and the device coupled to connector 7. This may also depend on the impedance of the device (e.g., headset or line out device) in contact with corresponding audio contacts of connector 7.

Voltage regulator circuit 40 includes low dropout regulator (LDO) 41 coupled between input 38A and charge pump 42. Pump 42 (e.g., based on output of LDO 41) is coupled to power outputs 31A (e.g., +BIAS, such as +VCP Filt) and 31B (e.g., −BIAS, such as −VCP Filt) to provide power (e.g., bias) to the headphone amplifiers positive and negative bias nodes, and to provide power to the line out amplifiers positive and negative bias nodes. Power outputs 31A and 31B have proper output power, characteristics and impedance to drive amplifiers 33L/R and 34L/R to provide appropriate audio output for a headset and for a line out device having a plug inserted into and having contacts in contact with corresponding contacts of connector 7. They also have proper output power, characteristics and impedance to drive a test signal output by amplifiers 33L/R. The test signal may be a known test signal having sufficiently high power to detect the signature of the signal across the sense resistor as described herein, and have an inaudible frequency.

FIG. 6 also shows 2.5 volts flowing from LDO 41 to charge pump 42. For example, the 2.5 volts could correspond to the level used during production of the test signal by amplifiers 33L/R to detect the impedance of the device connected to connector 7. However, it can be appreciated that different voltage values could be used, such as depending on the level and characteristics of the signals expected and desired from the circuitry.

Sense resistor 26A is shown coupled between input power pin 38A of audio codec 9 and Vcc main power node pin 27A to supply main power to the audio codec. Sense resistor 26A that is in series with power node 27A and the main power input of LDO 41. In this example, resistor 26A is a 3 Ohm sense resistor. However, it can be appreciated that a different impedance could be used, such as depending on the level of Vcc main power pin 27A; and input impedance and power demand of power input pin 38A of voltage regulator 40.

Line 28A is shown as two external lines or connections coupling opposite ends of resistor 26A to opposing inputs of analog front end (AFE) 39A which in turn provides output to ADC 35. Each of lines 28 may represent electronic connections, wires and/or PCB traces sufficient to determine the voltage across and/or current flowing through resistor 26 (e.g., a measured voltage across resistor 26A, such as describe for loads of FIGS. 5A-F) to detect a signature of that voltage or current as noted herein (e.g., see FIGS. 7-8 below). ADC 35 may also be used to detect a microphone input from a microphone contact of the accessory connector. For example, AFE 39A may also be coupled between a ground contact and the external microphone contact of connector 7. AFE 39A may represent an analog front end (AFE), such as a differential amplifier, operational amplifier, and/or a signal conditioning amplifier. AFE 39A may be able to process or convert to an analog signal (able to be converted to a digital signal by ADC 35) a microphone input signal from connector 7, and the signal across the sense resistor.

FIG. 6 shows controller 45 coupled to codec 9 through control signal lines 46 to turn on and off headphone amplifiers 33L/R and line out amplifiers 34L/R. In some cases, turning the amplifiers on and off may include sending signals through control signal lines 46 to circuitry of codec 9, and that circuitry turns the amplifiers on and off. In some cases, lines 46 may include a separate line for each pair of the amplifiers 33L/33R, and 34L/34R to send a separate signal for each pair to turn each pair on or off, simultaneously. In other cases, lines 46 may include a separate line for each of the amplifiers 33L, 33R, 34L and 34R to send a separate signal for each amplifier to turn each amplifier on or off, independently of every other amplifier. In some cases, each such separate line may send one signal to turn an amplifier on and a different signal to turn that amplifier off. In other embodiments, each such separate line may include two lines; one line to send a signal to turn an amplifier on, and a second line to send a signal to turn that amplifier off. Turning off an amplifier can be described as switching off (e.g., power to the amplifier), or disconnecting (e.g., from output 29/30 or connector 7) the amplifier. Turing on an amplifier can be described as selecting, switching on (e.g., power to the amplifier), or connecting (e.g., to output 29/30 or connector 7) the amplifier. In some cases, selecting the headphone amplifier describes switching that amplifier on, while switching off the line out amplifier. Correspondingly, selecting the line out amplifier may describe switching that amplifier on, while switching off the headphone amplifier.

FIG. 6 also shows various capacitors for filtering (e.g., 0.1 micro Farad and 0.01 micro Farad). However, it can be appreciated that different capacitance values (or none at all for these locations) could be used, such as depending on the level and characteristics of the signals expected and desired from the circuitry.

According to embodiments, controller 45 (in addition to the control lines shown in FIGS. 4 and 5A-C) is also coupled through control signal lines 46 to select between the headphone amplifiers and the line out amplifiers (and resistors 36L/R). Thus, controller 45 may be coupled to the digital to analog converter, the voltage regulator circuit, the analog to digital converter, and control signal lines 46. The controller may process an output of the analog to digital converter 35 to detect a current and/or voltage across the sense resistor 26, to detect the impedance of a device coupled to outputs 29 and 30 the headphone or line out amplifier.

The controller may process a high resistance impedance detection to indicate a line-in device, which is known or predetermined to be associated with a high input capacitance and low input power need (e.g., high resistance). In response, the controller may select line-out amplifiers 34L/R with decoupling resistors 36L/R to drive the "line-in" detected device. This may be done by sending a signal on a first control signal line to switch off amplifiers 33L/R, and sending a signal on a second control signal line to switch on amplifiers 34L/R.

Alternatively, the controller may process a low resistance impedance detection to indicate a headphone device (e.g., speaker), which is known or predetermined to have lower capacitance and require high input power need (e.g., low resistance. In response, the controller may select headphone amplifiers 33L/R (without decoupling resistors 36L/R) to drive the headphone detected device. This may be done by sending a signal on a first control signal line to switch on amplifiers 33L/R, and sending a signal on a second control signal line to switch off amplifiers 34L/R. In some cases, if headphone amplifiers 33L/R are already selected (e.g., powered on), no additional signal on a first control signal line is necessary.

In some embodiments, line 28A, resistor 26A (and optionally AFE 39A and ADC 35) may be described as a "sense circuit" to determine whether the impedance of a device coupled to the output of the headphone amplifier is the impedance of a headphone device or the impedance of a line out device.

According to embodiments, system 1 or device 3 may perform a process which may include a process for embodiments described for FIGS. 1-6. This process may be controlled by programmed processor 8. It may begin with a headset detect event, such as by using circuitry to determine that the plug of a headphone or line out device has been inappropriately inserted and in contact with corresponding contacts of the accessory connector. This process may include waking up the audio device or plugging in a plug into the accessory connector. Once or due to detecting the plug has been inappropriately inserted, the following additional process may be controlled or caused by the system or device (e.g., by processor 8).

Second, the codec (e.g., codec 9) may be powered up. In some cases, this process may include detecting whether the plug is a three or four region type plug.

Third, the codec will be configured depending on whether the plug detected is a three region or four region plug. For a three region plug, accessory connector 7 will be configured (such as by controller 45 and switches that may include switches of lines 29 and 30 (not shown) to activate three or four contacts or pins of connector 7. Such configuration may include at least one audio output pin or connector. The processes above may occur before the user experiences any audio output either from the headset or from the line out device.

Next, a processes to determine whether a headphone or to a self powered audio output device is connected to the accessory connector may be performed, such as described herein. This determination may be caused by, after or due to detecting the plug has been inappropriately inserted into connector 7. Such a process may be described below with respect to FIGS. 7-8. Following determine whether a headphone or to a self-powered audio output device is connected to the accessory connector, a normal line out or headphone amplifier audio mode may begin. In some cases the audio event may include a telephone call or audio output of music or other media played by system 1.

Figure 7:
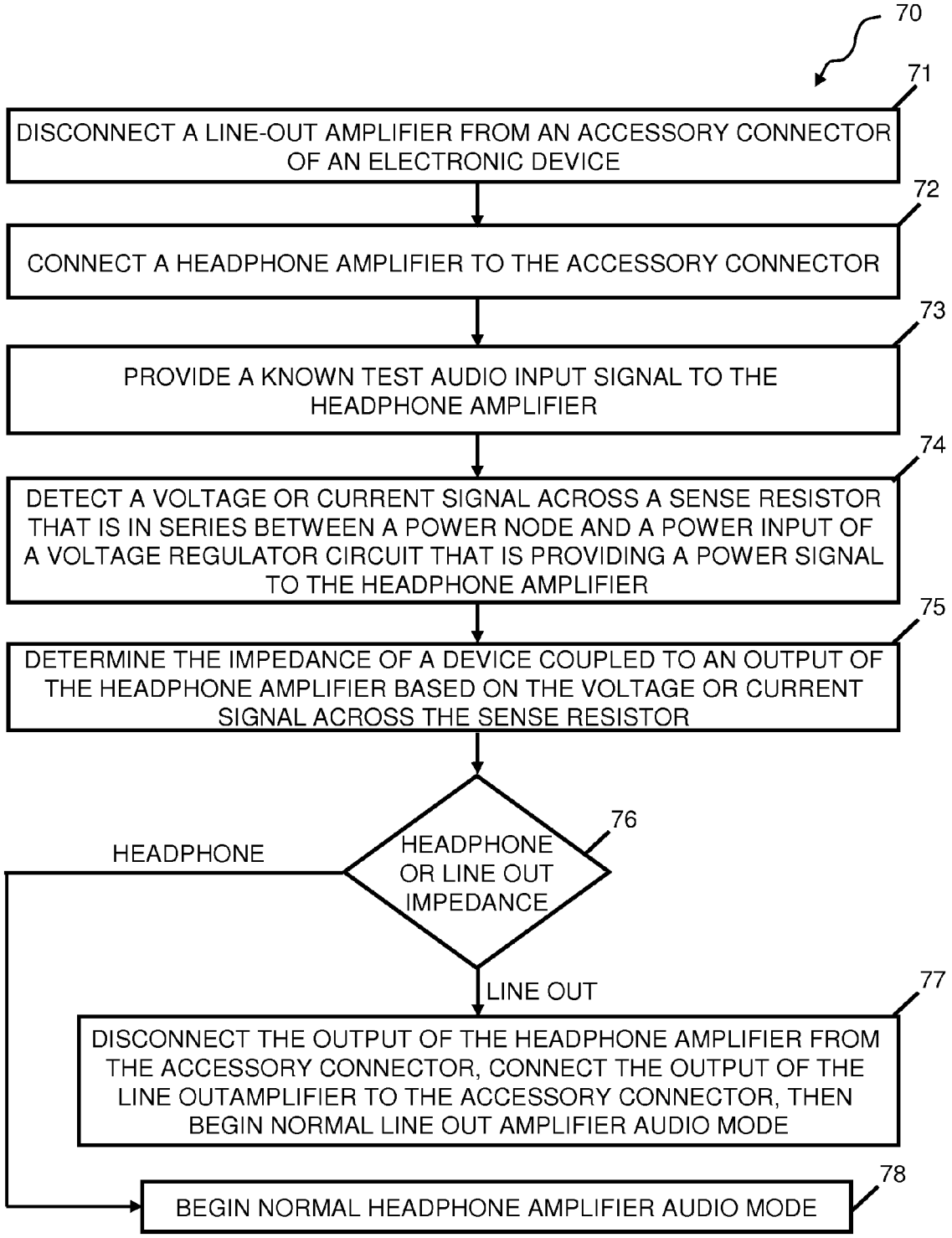
FIG. 7 is a flow diagram of an example process for using a sense circuit coupled in series between a power pin and a power input to a headphone amplifier to determine whether a headphone or to a self powered audio output device is connected to an accessory connector of an audio system.

FIG. 7 is a flow diagram of an example process for using a sense circuit coupled between a power pin and a power input to a headphone amplifier to determine whether a headphone or to a self powered audio output device is connected to an accessory connector of an audio system. FIG. 7 shows process 70 which may embody a process for embodiments described for FIGS. 1-6.

Process 70 starts with block 71 where, a line out amplifier is disconnected from an accessory connector of an electronic device. Block 71 may include disconnecting one or more (e.g., left and right) line out amplifiers from corresponding contacts of the connector. Such connecting may include turning off the line out amplifiers. In some cases, block 71 is not needed because the line out amplifier is already disconnected from an accessory connector of the electronic device.

At block 72 a headphone amplifier is connected to the accessory connector. Block 72 may include connecting one or more (e.g., left and right) headphone amplifiers to corresponding contacts of the connector. Such connecting may include turning on the headphone amplifiers. In some cases, block 72 is not needed because the headphone amplifier is already connected to an accessory connector of the electronic device. Also, block 72 may include un-muting headphone amplifiers 33 or 33L/R.

In some cases, the order of blocks 71 and 72 can be reversed, or performed simultaneously. Blocks 71 and 72 may be controlled or caused by controller 45 sending one or more signals on one or more control signal lines to the codec to cause the codec to switch on and off amplifiers 33L/R and 34L/R.

At block 73, a known test audio input signal is provided to the headphone amplifier. Block 73 may include providing a tone to the audio contacts of connector 7 that will produce a tone to speakers that is a high frequency that is not audible to humans (e.g., above hearing frequency, such as above 15 kHz, above 20 kHz, or above 22 kHz) but has low enough amplitude not to fold, and to be high enough to provide a signal across sense resistor 26 or 26A (or a load or parasitic resistance of a sense circuit as described herein) to be detected and distinguished by ADC 35 from input 39 or 39A. This known test audio signal may include "playing" 20 milliseconds of a −20 dBFS 21 kHz stereo sine wave with a sampling rate of 48 kHz, and left and right channels in phase with each other. Other appropriate test audio signals may also be used, such as an audio tone that causes a signature of sufficient amplitude to be detectable. In some cases, such a test audio signal includes output from the left and right amplifier of a test tone that is in phase, so that the output provides a heavy enough loading to make the signature visible on the power supply sense resistor (or sense circuits described herein).

Block 73 may presume that a device (e.g., headset or line out device) has a plug appropriately inserted into and in contact with corresponding audio contacts of connector 7. It is also considered that such a plug is inserted into and in contact during block 71 and/or 72.

For example, block 73 may include causing the DAC 37 or 37A to power up and be configured to send a test signal input to amplifiers 33 or 33L/R. Block 73 may be controlled or caused by controller 45 sending a signal to signal the voltage regulator circuit 40 and the digital to analog converter 37 or 37A to cause the headphone amplifier 33 or 33L/R to output a known test signal.

Block 73 may include outputting a known test signal for a period of time including a period of time when the signal across the sense resistor (or a load or parasitic resistance of a sense circuit as described herein) is being detected or monitored in block 74. Such a period of output may include a period of any of 5-10; 10-20; or 20-40 milliseconds. Other appropriate periods of time are also considered.

At block 74, a voltage and/or current signal is detected across a sense resistor that is in series with a power node a voltage regulator circuit that is providing a power signal to the headphone amplifier. Block 74 may also describe detecting a voltage or current in or across a load or parasitic resistance of a sense circuit as described herein. For example, block 74 may include causing the ADC 35 (and possibly AFE 39A) to power up and be configured to read the signal across sense resistor 26 or 26A.

Block 74 may include (e.g., controller 45) recording 10-20 milliseconds on ADC 35 (e.g., a MIC 1) audio input line. Such recording may be similar as using the ADC to detect (e.g., using pins or contacts of input 39 or AFE 39A) a microphone input from a microphone contact of the accessory connector. The recording may be proportional to a "MEDUSA" impedance. Block 75 may include post processing of the recorded 10-20 milliseconds to determine the impedance, such as by converting the signal into the frequency domain using a Fast Fourier Transform or band pass filter. In some cases, block 74 includes detecting (e.g., monitoring, recording and processing) to detect a signature across the sense resistor or circuit, during output of the known test signal described at block 73. For example, detecting during output of a period of a −20 dBFS 21 kHz stereo sine wave signal may include detecting or processing using a sampling rate of 48 kHz across a sense resistor, a load, or a parasitic resistance of a sense circuit as described herein. Other appropriate detecting and processing are also considered.

Block 74 may be controlled or received by controller 45 receiving a signal to indicate a voltage and/or current AC signal detected across a sense resistor (or a load or parasitic resistance of a sense circuit as described herein) using a signal sent to the controller from ACD 35. Block 74 may include monitoring the signal across the sense resistor (or a load or parasitic resistance of a sense circuit as described herein) over a period of time including a period of time when the test signal is being output at block 73. In some cases, this period will be shorter than the period of time when the test signal is being output at block 730. Such a period of monitoring may include a period of any of 5-10; 10-20; or 20-40 milliseconds. Other appropriate periods of time are also considered.

At block 75, the impedance of a device coupled to an output of the headphone amplifier is determined, based on the voltage or current AC signal across the sense resistor or sense circuit. At decision block 76, it is decided whether the determined impedance is that of a headphone device, or that of a line out device?

Figure 8:
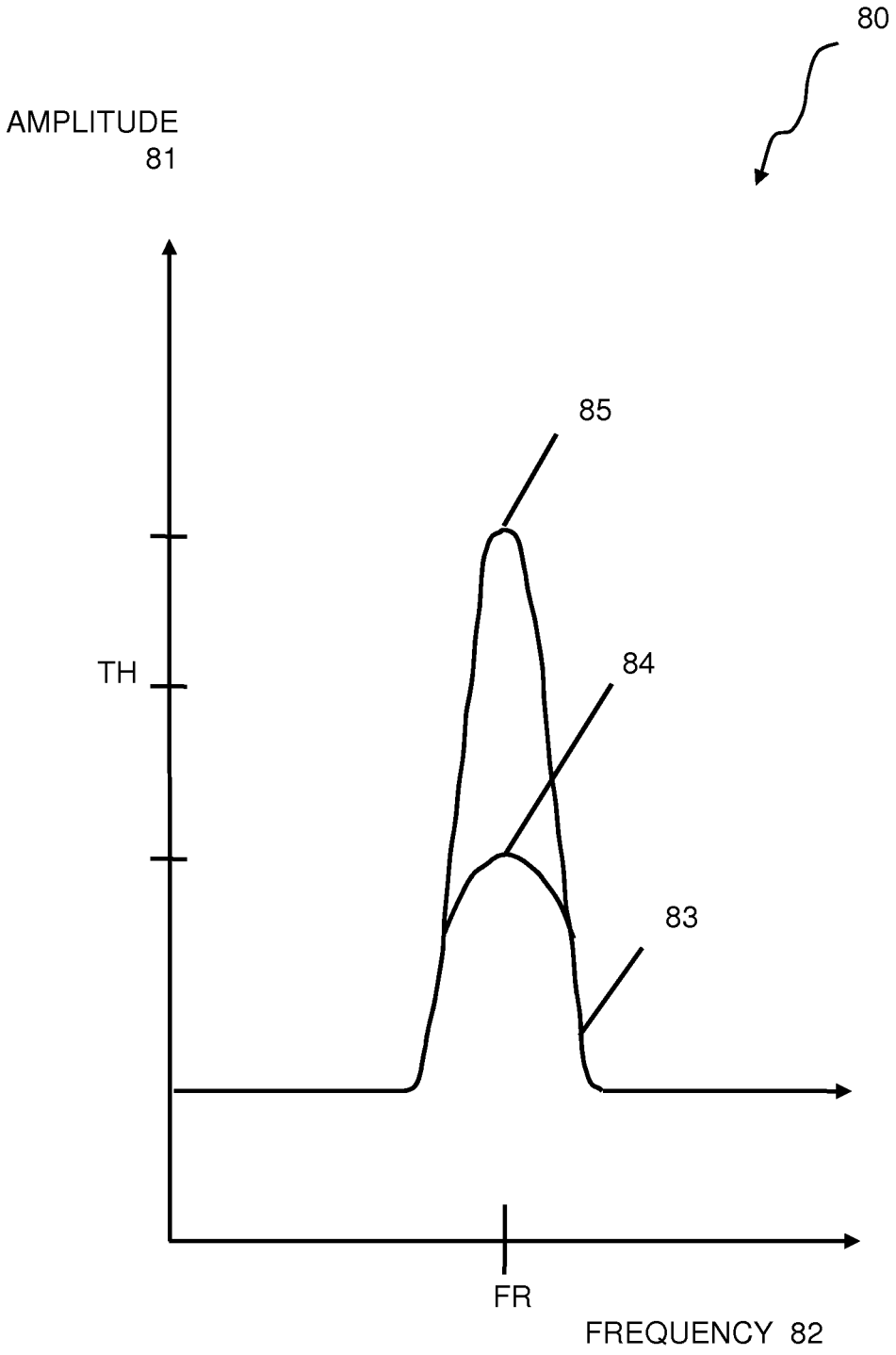
FIG. 8 shows an example of an amplitude versus frequency plot of the sensed current signature through the sense circuit after being frequency transformed.

Blocks 75 and 76 may be controlled by controller 45 comparing the signal received in block 74 from ACD 35 to various thresholds or tables (e.g., see FIG. 8). In some cases, the process of blocks 75 and 76 may include transforming the detection of the ADC into a peak that occurs above the noise level. The peak may be compared to a table or thresholds (e.g., corresponding the Ohm resistances noted below) to determine the impedance of the connected device to the contact or contacts (Left and Right attached to lines 29 and 30) of connector 7. The comparison considers that the power and frequency of the test signal produced and output by amplifier 33 or 33L/R is known (e.g., see block 73). In some cases, this process may include transforming the detection of the ADC into a peak that occurs above the noise level. The peak may be at approximately 21 kHz (e.g., for the know 21 kHz sine wave signal described at block 74).

If the determined impedance is that of a line out device, the process continues to block 77. In some cases, detection of an impedance greater than that for a headphone device may be a detection a line out device. In some cases, block 75 and 76 may include determining if the impedance detected of the device is greater than 3K Ohms. In some cases, detecting an impedance of the device in a threshold between 3000 and 10000 Ohms will identify a line out device. In some cases, this process may include transforming the detection of the ADC into a peak that occurs above the noise level. It may also include identifying the load of a line out device as an impedance of greater than 2000 Ohms. In the line out device case, processing continues to block 77.

If the determined impedance is that of a headphone device, the process continues to block 78. In some cases, detecting an impedance less than that for a line out device may be a detection of a headphone device. In some cases, block 75 and 76 may include determining if the impedance of the device is less than that indicated above for a line out device. In this case, it may be detected that the device is a headphone device. For example, it may be determined that the impedance of the device is less than 3000 Ohms. In some cases, a threshold between 3000 and 10000 Ohms may identify a headphone device. It may also include identifying the load of a headphone device as an impedance of less than or equal to 2000 Ohms. In some cases, detecting a headphone impedance may include detecting an impedance of less than or equal to 1000 Ohms, or 600 Ohms. Other thresholds are also considered. Some thresholds may be based on hardware limitations of the codec. For example, if it is know that the line out amplifier will not clip a full scale excitation signal until the load is less than 1000 Ohms, then the threshold may be set to switch to headphone mode at 750 Ohms. In the headphone device case, processing continues to block 78.

The impedance seen looking out of the audio contacts of connector 7 may be indirectly calculated based on the signature over time of current that is being driven through the sense resistor (or a load or parasitic resistance of a sense circuit as described herein). This may be detected simply using Ohm's law as a ratio of measured voltage over time of the signal across the resistor. Given the characteristics of this current and voltage; and knowing the power required to provide the known signal driven by the headphone amplifier, the impedance driven by that amplifier can be calculated. Thus, thresholds can be determined to identify or detect whether such impedance is the expected impedance for a headphone (e.g., headset speaker) or for a line out device (e.g., "line-in" input for a speaker channel of a self powered audio output device). When comparing the detected current or voltage across the sense resistor or sense circuit to the thresholds above (e.g., when selecting such thresholds), the following factors can be taken into account: the input and output characteristics an conversion of the voltage regulator, the headphone amplifiers, the differential amplifier and the ADC.

For example, FIG. 8 shows an example of amplitude 810 versus frequency 82 plot 80 of the frequency transformed (e.g. processed, such as into the frequency domain) signal 83 of the sensed current signature through (or voltage across) the sense resistor (or a load or parasitic resistance of a sense circuit as described herein). FIG. 8 shows peak 84 of signal 83, such as a low impedance peak expected for a headphone device. This may be a headset speaker impedance at the frequency of the test signal output by the headphone amplifier. FIG. 8 also shows peak 85 of signal 83, such as a higher impedance peak expected for a self powered "line-in" device. This may be a line-in impedance at the frequency of the test signal output by the headphone amplifier.

The peaks are shown at frequency FR, which may represent any of the frequencies mentioned herein for a signal signature detected across the sense resistor (or a load or parasitic resistance of a sense circuit as described herein). In some cases this frequency may be above 15 kHz, at 20 kHz or at 21 kHz. For example, this frequency may be determined by experimentation and/or by simulation to be the frequency of a signal having a signature caused by powering the headphone amplifier while it provides the known test signal to a headphone or self powered device having a plug properly inserted in to connector 7.

Threshold TH is shown between the two expected peaks 84 and 85. Threshold TH may represent a value determined to represent any of the impedance thresholds mentioned above. In some cases this frequency may be at 3000 Ohms, 2000 Ohms, or 1000 Ohms. For example, this value may be determined by experimentation and/or by simulation to be an amplitude that corresponds to the resistance thresholds for headphone and line out devices noted herein, for a signal having a signature caused by powering the headphone amplifier while it provides the known test signal to such a device.

According to some embodiments, dedicated hardware may be incorporated into the CODEC which essentially applies a band-pass filter (BPF) around the detection tone (e.g., around frequency FR so as to pass expected peaks 840 and 850), an energy estimator and digital comparator. This may allow detection to be done entirely in the CODEC without needing to bring the CODEC up, initializing the digital interfaces and processing the audio in the micro controller.

At block 77, the output of the headphone amplifier is disconnected from the accessory connector, the output of the line out amplifier is connected to the accessory connector, and then normal line out amplifier audio mode begins. Block 77 may include sending control signals over control signal lines to turn off headphone amplifiers 33L/R and to turn on line out amplifiers 34L/R. Block 77 may include disconnecting one or more (e.g., left and right) line headphone amplifiers from corresponding contacts of the connector. Block 77 may also include connecting one or more (e.g., left and right) line out amplifiers to corresponding contacts of the connector. Block 77, may also end with beginning normal line out amplifier audio mode.

Blocks 76 and 77 may be controlled or caused by controller 45 sending a si a through control signal lines 46 to circuitry of codec 9, and that circuitry turns the amplifiers on and off. Block 77 may also be controlled or caused by controller 45 sending a signal to DAC 37 or 37A to beginning normal line out amplifier audio mode, such as by transmitting audio content to amplifiers 34 or 34L/R.

For example, for blocks 74-77, if the impedance is a high resistance impedance, indicating a line-in device (e.g., self powered speaker device) having a high input capacitance and low input power need, a line-out amplifier may be selected with decoupling resistor to drive the "line-in" detected device.

At block 78, normal headphone amplifier audio mode begins. In some cases, block 78 does not require disconnecting and/or connecting any amplifiers (e.g., does not require any control signals) because the headphone amplifier is already connected to an accessory connector of the electronic device. If not, Block 78 may include blocks 71 and/or 72.

Blocks 76 and 78 may be controlled or caused by controller 45 sending a control signal to codec 9. Block 78 may be controlled or caused by controller 45 sending a signal to DAC 37 or 37A to beginning headphone amplifier audio mode, such as by transmitting audio content to amplifiers 33 or 33L/R.

For example, for blocks 74-76 and 78, if the impedance is a low resistance impedance, indicating a headphone device (e.g., a headphone speaker) having a low input capacitance and high input power need, and a headphone amplifier may be selected without decoupling resistor to drive the headphone detected device.

Although concepts above are described with respect to sending a test signal using amplifiers 33L and 33R while monitoring the signature across the sense resistor or sense circuit, it can be appreciated that in some embodiments, the test signal may be sent by only one of amplifiers 33L and 33R while monitoring the signature across the sense resistor or sense circuit.

It is also noted that some descriptions herein are with respect to the sense resistors being passive resistors; the power nodes being Vcc and GND; the detector being input 39 and/or ADC 35; and the connection from the sense resistor and the detector being line 28; and/or a sense circuit having a measured voltage across a load, or parasitic resistance. However, it can be appreciated that other designs and circuitry for sensing a signature of the power consumed by voltage regulator 40 are contemplated. In some cases different passive circuitry, active circuitry, or a combination thereof can be used to replace these components. For example, a transistor based detector could be used in place of these components.

Furthermore, although some of the concepts above are described with respect to sensing a signal across the sense resistor (or a load or parasitic resistance of a sense circuit as described herein) while the headphone amplifier(s) send a test signal the attached device, it can be appreciated that in other embodiments, the line out amplifiers could be used to provide the test signal instead of the headphone amplifiers. This could apply to embodiments where the test signal and sense resistor (or a load or parasitic resistance of a sense circuit as described herein) are designed to provide a signal across the resistor with a signature sufficient to detect whether the device connected to connector 7 is a headphone or line out type device.

Next, although some concepts above are described with respect to three and four contact jacks/connectors with corresponding plug contacts, they can also be applied to a four contact jack, when a three region plug is inserted (e.g., one contact of the four region connector is not in contact with a plug contact). They can also be applied to a three contact jack, when a three region or four region plug is inserted (e.g., one contact of the four region plug is not in contact with a contact).

It is noted that the embodiments above provide an efficient and effective detection of the input power signal signature. They also provides a fast and automatic detection of the device connected to connector 7 so that the controller can more quickly and accurately determine and switch to the proper headphone or line out amplifier and output line. This reduces user discomfort (e.g., listening to audio silence, pops, and detection signals) and wait time when using the device.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, although the audio system 1 depicted in the figures may be a portable device, a telephone, a cellular telephone, a smart phone, digital media player, or a tablet computer, the audio system may alternatively have be a different portable device such as a laptop computer, a hand held computer, or even a non-portable device such as a desktop computer or a home entertainment appliance (e.g., digital media receiver, media extender, media streamer, digital media hub, digital media adapter, or digital media renderer). The description is thus to be regarded as illustrative instead of limiting.

What is claimed is:

1. An audio system comprising:

a connector having an audio contact to interface the audio system with a connected external device;

an audio codec integrated circuit having a digital to analog converter (DAC), an audio headphone amplifier having an input coupled to an output of the DAC and an output coupled to the audio contact of the connector;

a sense circuit that is electrically connected (1) between a power supply node and an input power node of a voltage regulator circuit providing power to the headphone amplifier or (2) between an output of the voltage regulator circuit and an input power node of the headphone amplifier;

a processor;

data storage containing stored instructions that program the processor to select an audio output mode of operation being one of a line out mode and headphone mode based on a signal detected across the sense circuit.

2. The audio system of claim 1 wherein the sense circuit comprises a passive sense resistor that is series-coupled between a power node and an input power pin of the codec.

3. The audio system of claim 2 wherein the audio integrated circuit further comprises an analog to digital converter (ADC) having an input coupled across the sense resistor, the data storage contains further stored instructions which program the processor to read output of the ADC, process the reading to detect an impedance of the connected external device as the impedance of a line out device or as the impedance of a headphone device.

4. The audio system of claim 1 having a first state in which the processor determines the type of external device as being a headset, the processor selects an audio output headphone mode of operation which connects a headphone amplifier to the audio contact, and a second state in which the processor determines the type of external device as being a line in device, the processor selects an audio output line out mode of operation which connects a line out audio amplifier and an isolation resistor to the audio contact.

5. The audio system of claim 4 wherein in the line out mode a passive resistor is switched in as the isolation resistor to increase the output impedance, and in the headphone mode the passive resistor is switched out to decrease the output impedance.

6. The audio system of claim 1 wherein the audio system is installed in a portable audio system housing.

7. An electronic audio device comprising:

a headphone amplifier coupled to an accessory connector;

a line out amplifier capable of being coupled to the accessory connector;

a digital to analog converter having an output coupled to provide an audio input signal to inputs of the headphone and line out amplifiers;

a voltage regulator circuit coupled to provide power to the headphone and line out amplifiers;

an analog to digital converter having an input coupled to detect a signal across a sense circuit that is electrically connected (1) between a power supply node and a power node of the voltage regulator circuit that receives power from the power supply node or (2) between an output of the voltage regulator circuit and an input power node of the headphone amplifier that receives power from the voltage regulator circuit; and a controller coupled to the digital to analog converter, the voltage regulator circuit and the analog to digital converter, the controller is configured to process an output of the analog to digital converter to detect a signature of the signal across the sense circuit as representing impedance of a device that is coupled to an output of the headphone amplifier through the accessory connector.

8. The device of claim 7, wherein the sense circuit is a passive sense resistor, and the power node is one of a power supply node and a power return node of the voltage regulator circuit.

9. The device of claim 7, wherein:

the headphone amplifier is to provide a headphone amplified audio signal and a known test signal to the accessory connector;

the line out amplifier is to provide a line-out amplified audio signal to the accessory connector;

the digital to analog converter is to provide an audio input signal to the headphone amplifier and the line out amplifier;

the analog to digital converter is to detect a fixed frequency voltage signal across a current sense resistor.

10. The device of claim 9, further comprising:

a first control signal line to switch on and off the headphone amplifier; and a second control signal line to switch on and off the line out amplifier; and a controller coupled to the first control signal line, the second control signal line, the digital to analog converter, the voltage regulator circuit and the analog to digital converter;

the controller to detect an impedance of a device coupled to an output of the headphone amplifier based on the fixed frequency voltage signal across the current sense resistor.

11. The device of claim 8, wherein the device comprises an audio codec circuit including:

the headphone amplifier;

the line out amplifier;

the digital to analog converter;

the voltage regulator circuit;

the analog to digital converter and the input; and wherein the sense resistor, the power node, and the controller are located external to the codec circuit.

12. An electronic audio device comprising:

a headphone amplifier;

a line out amplifier;

a digital to analog converter having an output coupled to inputs of the headphone and line out amplifiers;

a voltage regulator circuit coupled to power the headphone and line out amplifiers; and an analog to digital converter having an input coupled to a sense circuit that is in series with a) an input power node of the voltage regulator circuit while the headphone amplifier is outputting an audio signal or b) an input power node of the headphone amplifier while the headphone amplifier is outputting an audio signal; and a controller that can discriminate between different types of devices, which are alternately connected to the headphone amplifier, by processing output of the analog to digital converter to detect different power drain levels from the voltage regulator circuit or from the headphone amplifier, while the audio signal is being outputted.

13. The device of claim 12, further comprising:

a first control signal line to turn on and off the headphone amplifier; and a second control signal line to turn on and off the line out amplifier;

wherein the controller is coupled to the first control signal line, the second control signal line, the digital to analog converter, the voltage regulator circuit and the analog to digital converter;

the controller to detect which type of device is coupled to an output of the headphone amplifier based on a fixed frequency voltage signal across the current sense circuit.

14. The device of claim 13, wherein the controller is configured to process an output of the analog to digital converter to detect a signal across a current sense resistor, for detecting which type of device is coupled to an output of the headphone amplifier.

15. The device of claim 14, wherein the controller is configured to:

process a high resistance impedance detection to indicate line-in and to select the line-out amplifier with a decoupling resistor; and process a low resistance impedance detection to indicate a headphone and to select the headphone amplifier.

16. The device of claim 13, wherein the controller is configured to:

send a signal on the second control signal line to turn off the line out amplifier;

signal the voltage regulator circuit and the digital to analog converter to cause the headphone amplifier to output a first signal; then if the fixed frequency voltage signal across the current sense circuit indicates that a self powered speaker device is coupled to the output of the headphone amplifier, turn off the headphone amplifier and turn on the line out amplifier.

17. The device of claim 14, wherein the device comprises an audio codec circuit including:

the headphone amplifier;

the line out amplifier;

the digital to analog converter;

the voltage regulator circuit;

the analog to digital converter and the input; and wherein the sense resistor and the controller are located external to the codec circuit.

18. A method of operating an electronic audio device comprising:

disconnecting a line-out amplifier from an accessory connector of an electronic device;

connecting a headphone amplifier to the accessory connector;

outputting a known signal from the headphone amplifier to the accessory connector;

detecting a voltage or current alternating current signal across a sense circuit that is electrically connected (1) between a power supply node and an input power node of a voltage regulator circuit that is providing power to the headphone amplifier or (2) between an output of the voltage regulator circuit and an input power node of the headphone amplifier; and determining using the detected voltage or current ac signal whether or not to turn off, or disconnect from the accessory connector, the headphone amplifier and connect the line-out amplifier to the accessory connector.

19. The method of claim 18, wherein there is a self-powered speaker connected to the accessory connector, when the headphone amplifier is disconnected or turned off and the line-out amplifier is connected to the accessory connector.

20. The method of claim 18, further comprising:

selecting a decoupling resistor when the line-out amplifier is connected to drive the accessory connector, and the headphone amplifier is disconnected or turned off; and deselecting the decoupling resistor when the headphone amplifier is connected to drive the accessory connector or is turned on.

* * * * *